US012059063B2

(12) United States Patent
Gomez-Morillo

(10) Patent No.: US 12,059,063 B2
(45) Date of Patent: Aug. 13, 2024

(54) REVERSIBLE AND EXPANDABLE HANDBAG

(71) Applicant: Arlene Gomez-Morillo, San Juan, PR (US)

(72) Inventor: Arlene Gomez-Morillo, San Juan, PR (US)

( * ) Notice: Subject to any disclaimer, the term of this patent is extended or adjusted under 35 U.S.C. 154(b) by 141 days.

(21) Appl. No.: 17/681,287

(22) Filed: Feb. 25, 2022

(65) Prior Publication Data

US 2022/0192333 A1 Jun. 23, 2022

Related U.S. Application Data

(63) Continuation-in-part of application No. 15/963,855, filed on Apr. 26, 2018, now Pat. No. 11,284,690.

(51) Int. Cl.

| | |
|---|---|
| ***A45C 7/00*** | (2006.01) |
| ***A45C 3/06*** | (2006.01) |
| ***A45C 13/02*** | (2006.01) |
| ***A45C 13/10*** | (2006.01) |

(52) U.S. Cl.

CPC ..... *A45C 7/0063* (2013.01); *A45C 3/06* (2013.01); *A45C 13/02* (2013.01); *A45C 13/1046* (2013.01)

(58) Field of Classification Search

CPC ..... A45C 7/0063; A45C 3/06; A45C 13/02; A45C 13/1046

See application file for complete search history.

(56) References Cited

U.S. PATENT DOCUMENTS

| | | | | |
|---|---|---|---|---|
| 5,046,860 | A * | 9/1991 | Brennan | A45C 3/04 D34/1 |
| 5,813,445 | A * | 9/1998 | Christman | A63F 3/06 150/112 |
| 2008/0000914 | A1* | 1/2008 | Frankenstein | A45C 13/02 220/507 |
| 2009/0065110 | A1* | 3/2009 | Cassella | A45C 13/02 224/581 |
| 2022/0265032 | A1* | 8/2022 | Datcher | A61L 2/26 |

OTHER PUBLICATIONS

Little Mamma's House, Handbag Facelift | How to Clean the Interior of Your Louis Vuitton Handbag, https://www.youtube.com/watch?v=Szl7IKYCfDE, Aug. 11, 2017 (Year: 2017).*

* cited by examiner

*Primary Examiner* — Tri M Mai

(74) *Attorney, Agent, or Firm* — Eugenio J. Torres-Oyola; Victor M. Rodriguez-Reyes; Rafael Rodriguez-Muriel

(57) ABSTRACT

A reversible, expandable, reusable and versatile handbag that has a rectangular proportion and contains two inner pockets each sewn on the side and not fixed at the bottom and at least one outer front pocket. The reversible aspect of the handbag allows it to go from one size to another with the simple action of inverting or flipping the bag inside out because the inside pockets become outer pockets.

15 Claims, 31 Drawing Sheets

REVERSIBLE AND EXPANDABLE HANDBAG

RELATED APPLICATIONS

This application is a continuation-in-part of, and claims priority from, U.S. application Ser. No. 15/963,855, filed on Apr. 26, 2018, the contents of which are fully incorporated by reference.

BACKGROUND OF THE INVENTION

The issues of sustainability and the conservation of resources are important for both the individual and the collective. In recent times we have seen governments, diverse industries and the individual citizen as well, exercising responsible practices towards conservation of the environment; either through the reduction of consumption, and the recycling and reuse of materials. The plastic bag for free distribution in supermarkets and other businesses, specifically represents one of the most common environmental problems, since mostly become marine litter. The plastic bag which is made of polyethylene, polypropylene and non-biodegradable polymer, was commercially introduced during the seventies, and became popular for its easy use and production. As a response to this situation more recently, businesses—both by mandate or by choice—have eliminated the use and free distribution of plastic bags, for the use of reusable bags. Unlike the plastic bag, the reusable bag is mostly made of biodegradable material, recycled material and is manufactured in a responsible manner with the environment. However, both the plastic bag and the reusable bag may not meet some user needs in terms of aesthetics, size, use and durability. A supermarket customer would most likely need multiple plastic or reusable bags for its purchases, making these bags inefficient. Also, the user of the plastic or reusable bags may not like to be associated with advertisements attached to these bags; or the quality of the material may be such that it compromises the integrity of the bag.

Meanwhile, in the fashion design industry it is common to find clothes and accessories with dual use, whether aesthetic or functional. For example, there are reversible clothes and accessories that offer different colors, patterns or design options. In the case of luggage, expandable luggage increase their storage volume through the use of a zipper. However, these accessories lack simplicity or require a substantial amount of the user or wearer's time to change the size of the accessory. For example, zippers may get stuck thus rendering the bag incapable of expanding in size.

Therefore, a need has been identified for a bag that can be both reversible and expandable without requiring the user to invest much time and effort in assembling. The usefulness of the claimed invention lies in its ability to be reversible, to expand and to change size, without the need of add-ons. The claimed invention allows the costumer or user to reuse it beyond the common supermarket use, since it can be used as a sports bag, tote bag, purse, beach bag, everyday bag, among others. The claimed invention, as an accessory can be adapted to other uses such as bags or backpacks.

SUMMARY OF THE INVENTION

The disclosure relates to a reversible, expandable, reusable and versatile handbag that is available in different combinations of colors and textures. The handbag has a rectangular proportion and contains two inner pockets each sewn on the side and not fixed at the bottom and three outer front pockets. The handbag is versatile since it may be used to complement an outfit or as beach bag, gym bag, sports bag, etc. It can be reused, and its quality is mainly achieved through the mesh or fabric of the bag. The reversible aspect of the handbag allows it to go from one size to another with the simple action of inverting or flipping the bag inside out, because the inside pockets become outer pockets. The handbag may include a closing mechanism to restrict access into its interior. Similarly, the two inner pockets may also include a closing mechanism configured to restrict access into the corresponding inner pocket.

The handbag comprises at least five (5) panels that define the front, back, lateral sides and bottom of the handbag; two handles; two interior pockets; and three exterior pockets. The grips or handles are stitched without interruption through the front and back panels. On the front panel, the three outer pockets are located and are formed by a single cross-sewn panel, which, when the handles are sewn lengthwise, form the divisions of each of the outer pockets. The seams of the edges of the bottom, sides and top of the bag are covered by a bias. Inside the handbag there are two pockets comprising four sides, one of which is one of the side panels of the bag.

DETAILED DESCRIPTION OF THE INVENTION

Exemplary embodiments of the present invention will now be described in detail with reference to the accompanying drawings. Detailed descriptions related to well-known functions or configurations will be ruled out in order not to unnecessarily obscure subject matters of the present invention.

Figure 1:
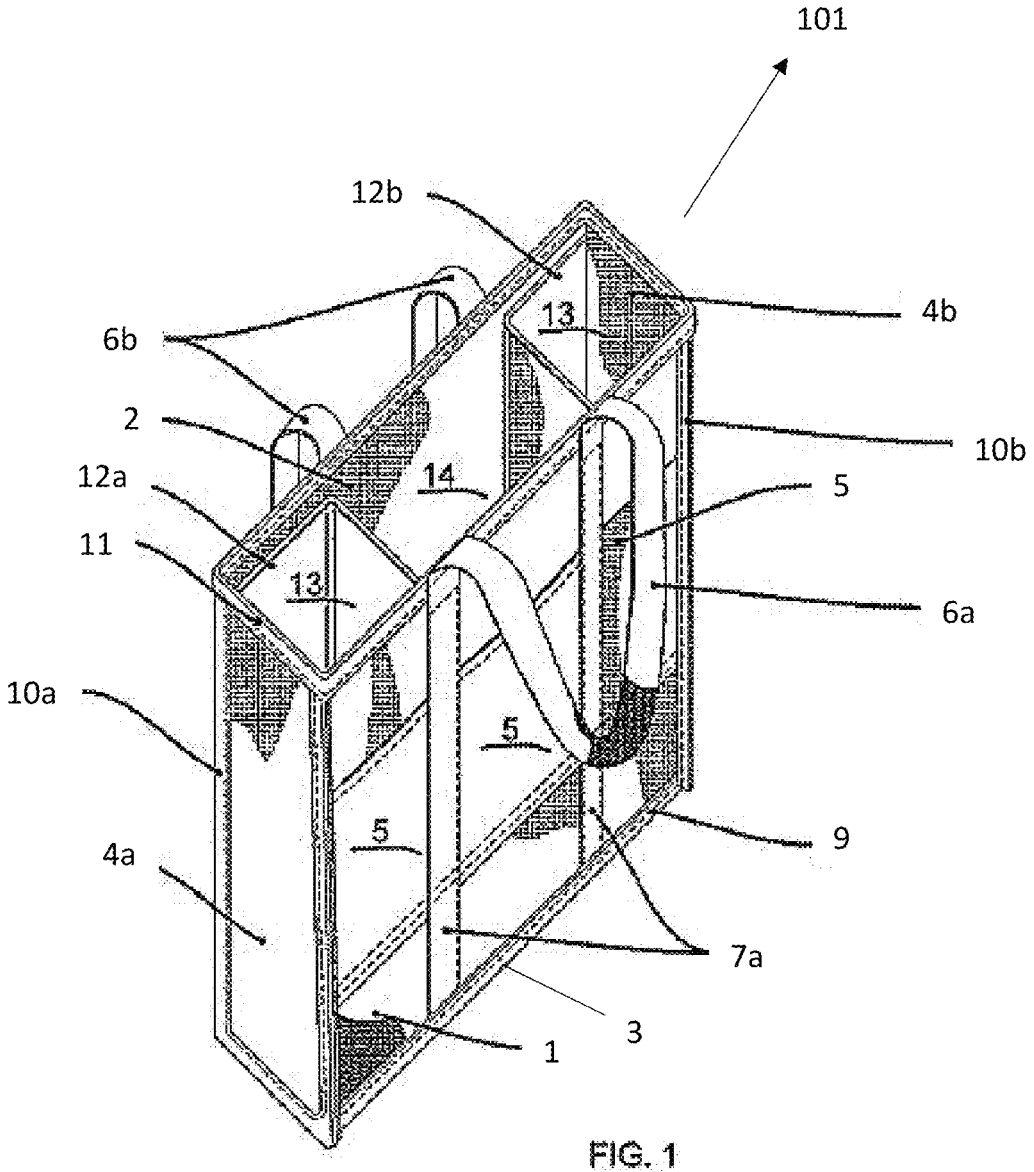
FIG. 1 shows a perspective view of a reversible and expandable handbag with lateral inner pockets.

FIG. 1 shows a perspective view of a reversible and expandable handbag 101. In particular, the handbag 101 has a rectangular proportion and comprises at least a front panel 1, at least a back panel 2, a bottom panel 3 and at least a first lateral panel 4*a* and a second lateral panel 4*b*, each panel interconnected with each other to define the interior of the handbag. Each panel further comprises first and second vertical sides or edges and first and second horizontal sides or edges. Furthermore, the panels are interconnected with each other through corresponding seams in the following manner: the first horizontal side of the front panel 1 is perpendicularly attached, fixed or sewn to the first horizontal side of the bottom panel; the first horizontal side of the back panel 2 is perpendicularly attached or sewn to the second horizontal side of the bottom panel 3; the first horizontal side of the first lateral panel 4*a* is perpendicularly attached or sewn to first vertical side of the bottom panel 3; and the first horizontal side of the second lateral panel 4*b* is perpendicularly attached or sewn to the second vertical side of the bottom panel 3. Additionally, the first vertical side of the front panel 1 is attached or sewn to the first vertical side of the first lateral panel 4*a* and the second vertical side of the front panel 1 is attached or sewn to the first vertical side of the second lateral panel 4*b*. Similarly, the first vertical side of the back panel 2 is attached or sewn to the second vertical side of the first lateral panel 4*a* and the second vertical side of the back panel 2 is attached or sewn to the second vertical side of the second lateral panel 4*b*.

In addition, a first corner on the second horizontal side of the front panel 1 is sewn or attached to a first corner on the second horizontal side of the first vertical panel 4*a*, and a second corner on the second horizontal side of the front panel 1 is sewn or attached to a first corner on the second horizontal side of the second lateral panel 4*b*. Similarly, a first corner on the second horizontal side of the back panel 2 is sewn or attached to a second corner of the second horizontal side of the first lateral panel 4*a*, and a second corner of the second horizontal side of the back panel 2 is sewn or attached to a second corner on the second horizontal side of the second lateral panel 4*b*. Such configuration creates an opening at the top of the handbag 101 that allows a user to gain access to the interior 14 of said handbag 101.

The interior 14 of the handbag 101 further comprises at least a first inner pocket 12*a* and second inner pocket 12*b*, wherein the first inner pocket 12*a* is attached or sewn to both the first and second vertical sides of the first lateral panel 4*a* and the second inner pocket 12*b* is attached or sewn to both the first and second vertical sides of the second lateral panel 4*b*. It should be noted, however, that the first and second inner pockets 12*a* and 12*b* are not fixed or attached to the bottom panel 3, but rather to respective bottom ends 15*a* and 15*b*, which are independent of the bottom panel 3. In other words, the first inner pocket 12*a* includes or is attached to a first bottom end 15*a* and the second inner pocket 12*b* includes or is attached to a second bottom end 15*b*, each end independent of the bottom panel 3. In a preferred embodiment, the first inner pocket 12*a* has three vertical panels interconnected with each other and perpendicularly attached to the first bottom end 15*a*, wherein the first vertical panel of the first inner pocket 12*a* is also connected to the first vertical side of the first lateral panel 4*a*, the second of the vertical panels of the first inner pocket 12*a* is connected to the second vertical side of the first lateral panel 4*a* and the third vertical panel of the first inner pocket 12*a* is connected to the first and second vertical panels of the first inner pocket 12*a*. Similarly, in the same preferred embodiment, the second inner pocket 12*b* has three vertical panels interconnected with each other and perpendicularly attached to the second bottom end 15*b*, wherein the first vertical panel of the second inner pocket 12*b* is also connected to the first vertical side of the second lateral panel 4*b*, the second vertical panel of the second inner pocket 12*b* is connected to the second vertical side of the second lateral panel 4*b* and the third vertical panel of the second inner pocket 12*b* is connected to the first and second vertical panels of the second inner pocket 12*b*.

Additionally, the handbag 101 comprises at least a first handle strap 6*a* and a second handle strap 6*b*, wherein the first handle strap 6*a* is attached or sewn to the second horizontal side of the front panel 1 and the second handle strap 6*b* is attached or sewn to the second horizontal of the back panel 2. The straps 6*a* and 6*b* may be attached to an inner portion or an outer portion of the corresponding front panel 1 and back panel 2. Furthermore, each handle strap 6*a* and 6*b* includes an extended portion 7*a* and 7*b* respectively, wherein the extended portion 7*a* is attached or sewn across the length of the front panel 1 starting at the second horizontal side of the front panel 1 and ending at the first horizontal side of the front panel 1, and the extended portion 7*b* is attached or sewn across the length of the back panel 2 starting at the second horizontal side of the back panel 2 and ending at the first horizontal side of the back panel 2. In a preferred embodiment the extended portions 7*a* and 7*b* are also attached or sewn to the bottom panel 4 for reinforcement, thus forming a reinforcement strap 8. Furthermore, the handbag 101 compromises at least one front pocket 5 formed by a single cross-sewn panel across the front panel 1 and/or back panel 2, which, when the extended portions 7*a* and 7*b* of the handle straps 6*a* and 6*b* are sewn lengthwise to the front panel 1 and/or back panel 2, forms the divisions of the at least one outer pocket 5.

It should also be noted that the handbag 101 further comprises a bottom bias 9 surrounding at least the first and second horizontal sides of the bottom panel 3; a first lateral bias 10*a* surrounding at least the first and second vertical sides of the first lateral panel 4*a* as well as the first horizontal side of the first lateral panel 4*a*; a second lateral bias 10*b* surrounding at least the first and second vertical sides of the second lateral panel 4*b* as well as the first horizontal side of the second lateral panel 4*b*; and a top bias 11 surrounding at least the second horizontal side of the front panel 1, the second horizontal side of the back panel 2 and the second horizontal side of the first and second lateral panels 4*a* and 4*b*. When sewing or attaching the straps 6*a* and 6*b*, the seam of the front panel 1 and back panel 2 is recessed before reaching the second vertical side of each panel to leave space for the finishing the corresponding bias. Lastly, it should also be noted that each inner pocket 12*a* and 12*b* also has a bias 17*a* and 17*b*, surrounding all sides of said inner pockets 12*a* and 12*b*, respectively. In other words, the first inner pocket 12*a* includes a first inner bias 17*a* surrounding all sides of said first inner pocket 12*a* and the second inner pocket 12*b* includes a second inner bias 17*b* surrounding all sides of said second inner pocket 12*b*.

The material of the handbag 101 is preferably selected from the following types of fibers/textiles: vinyl-coated fiberglass mesh; TEXTILENE® mesh; or polyester fiber mesh covered in polyvinyl chloride (PVC). Nevertheless, and in addition to the types of fiber/textiles mentioned, the bag can be made of any type of textile, both synthetic and natural fibers. Additionally, the biases sewn on the outer edges, the grips, handles and support at the bottom can be made of belts and/or ribbons of nylon, polyester or polypropylene that come in different colors and combinations.

Figure 2:
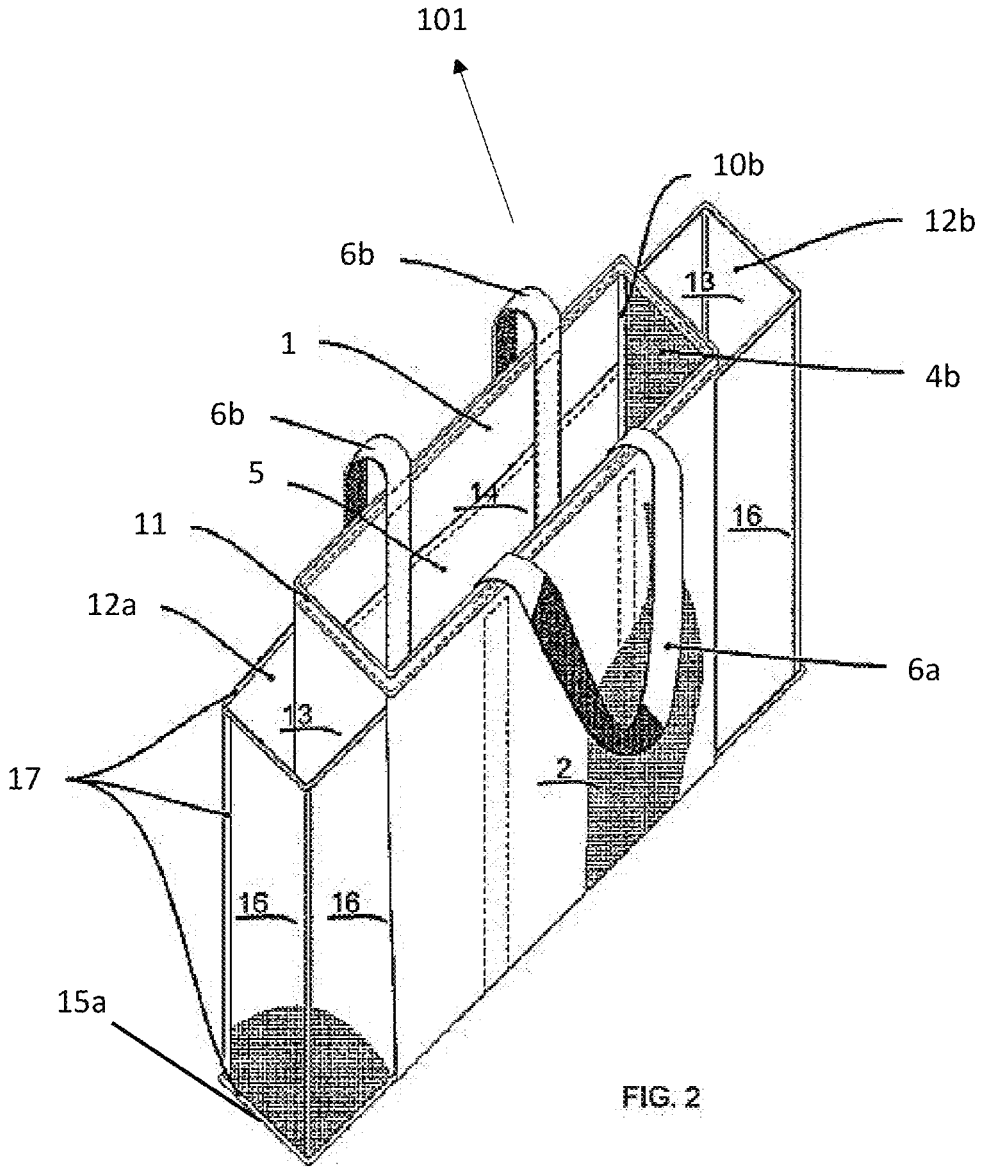
FIG. 2 shows a perspective view of the reversible and expandable handbag with lateral inner pockets, in its reversible expandable configuration.

As shown in FIG. 2, the size of the handbag 101 can be expanded by inverting or flipping the handbag inside out, thus achieving a reversible expandable configuration. Once the handbag is flipped inside out the first and second inner pockets 12*a* and 12*b* expand laterally and cause the handbag 101 to increase in size. In other words, the handbag 101 increases its size when flipped inside out because the inner pockets 12*a* and 12*b* becomes outer pockets and increase the surface area of the handbag 101.

Figure 3:
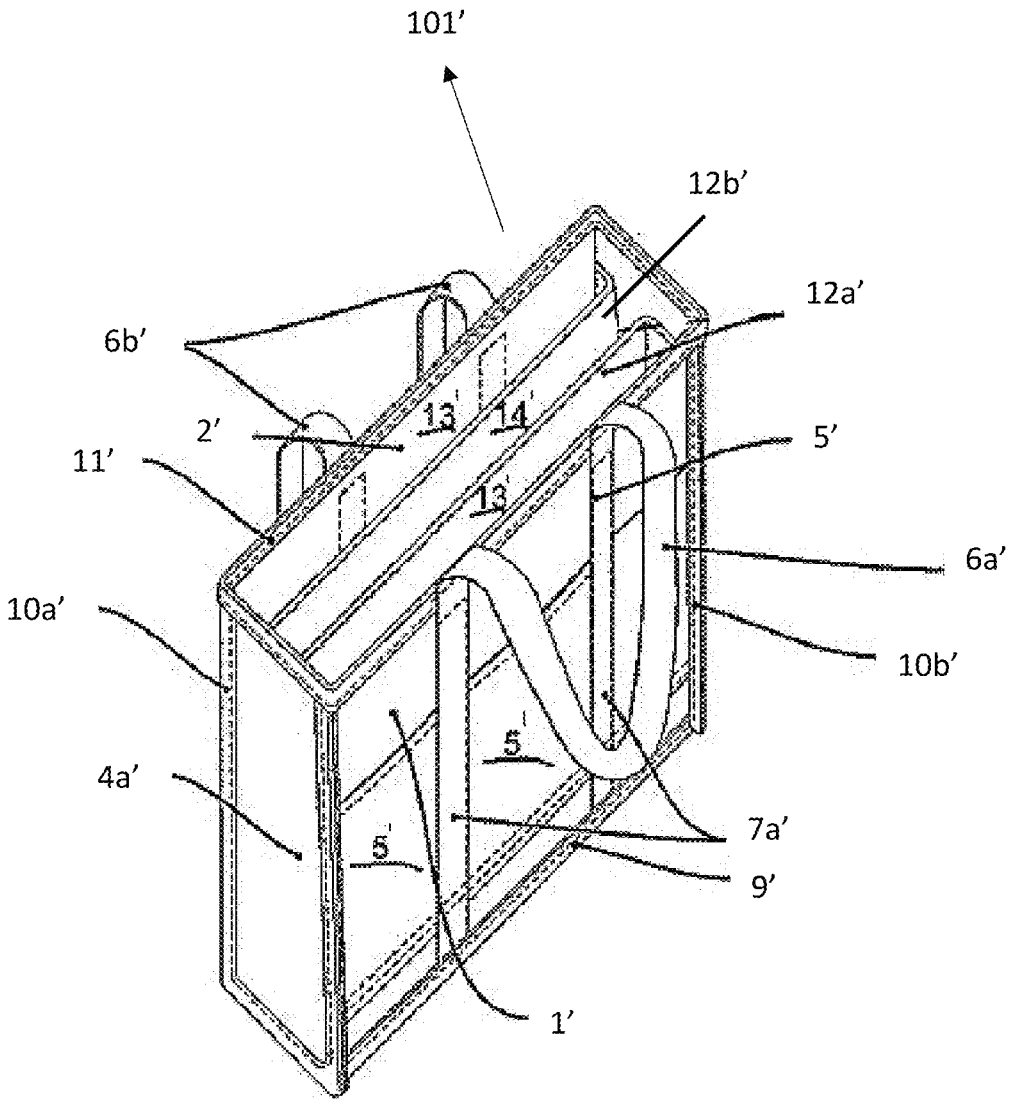
FIG. 3 shows a perspective view of the reversible and expandable bag with panel inner pockets.
Figure 4:
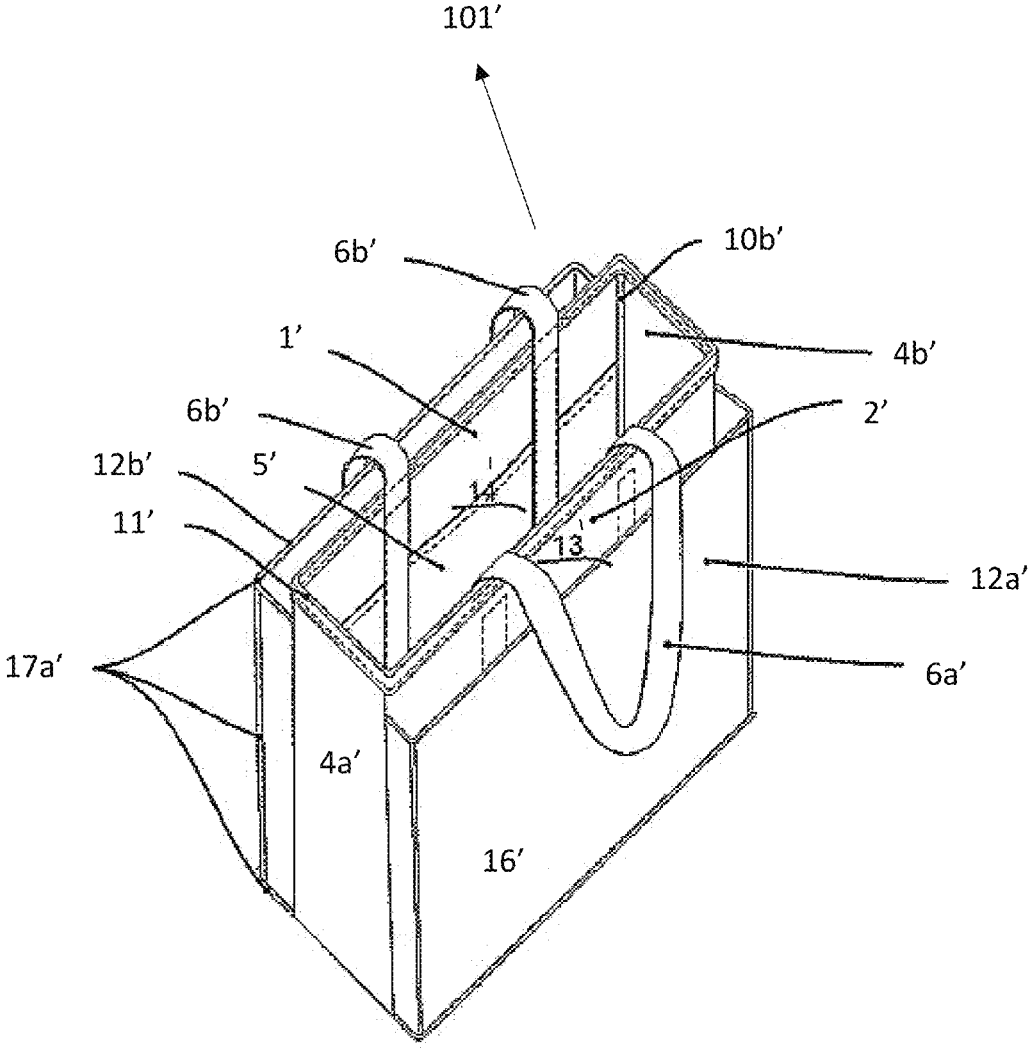
FIG. 4 shows a perspective view of the reversible and expandable handbag with panel inner pockets, in its reversible expandable configuration.

As shown in FIG. 3, the first inner pocket 12*a*' can instead be attached or sewn to both the first and second vertical sides of the front panel 1' and the second inner pocket 12*b*' can instead be attached or sewn to both the first and second vertical sides of the back panel 2'. As shown in FIG. 4, in this configuration the first and inner pockets 12*a*' and 12*b*' would expand longitudinally instead of laterally once the handbag 101' is flipped inside out to achieve the reversible and expandable configuration. Thus, in this configuration the first inner pocket 12*a*' would be located on the front panel 1' and the second inner pocket 12*b*' would be located would be located on the back panel 2. It should be noted that the embodiment shown in FIGS. 3-4 includes elements that are analogous to those described in FIGS. 1-2. These analogous elements have been identified with the same reference numeral as those in FIGS. 1-2, except that the reference numerals in FIGS. 3-4 also have an apostrophe right next to each reference numeral to distinguish them from the ones in FIGS. 1-2. The same logic applies to all reference numerals in the Figures that have an apostrophe. In other words, elements 1', 2', 4*a*', 5', 6*a*', 6*b*', 7*a*', 9', 10*a*', 10*b*', 11', 12*a*', 12*b*', 13' 14', 17*a*', 17*b*' in FIGS. 3, 4, 9, 12, 14, 16, and 18 are analogous to elements 1, 2, 4*a*, 5, 6*a*, 6*b*, 7*a*, 9, 10*a*, 10*b*, 11, 12*a*, 12*b*, 13 14, 17*a*, 17*b* described in FIGS. 1, 2, 5-8, 10, 11, 13, 15, 17, 19, 20.

Figure 5:
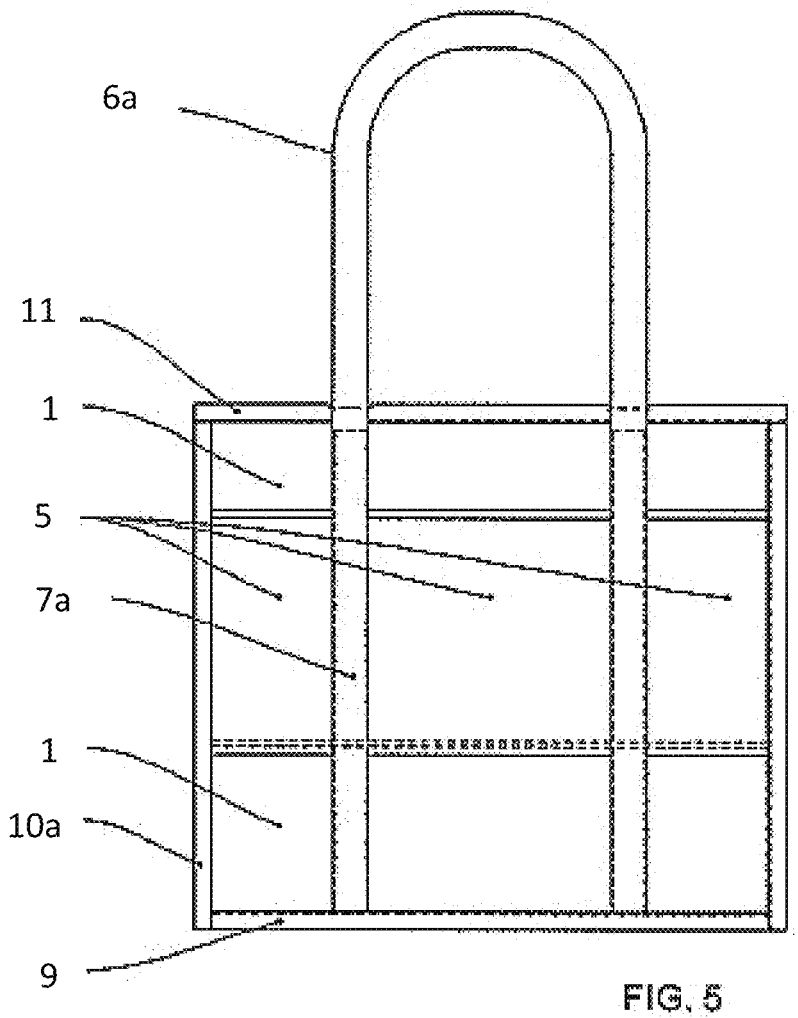
FIG. 5 is a front view of the reversible and expandable handbag showing at least one pocket on the front panel.
Figure 6:
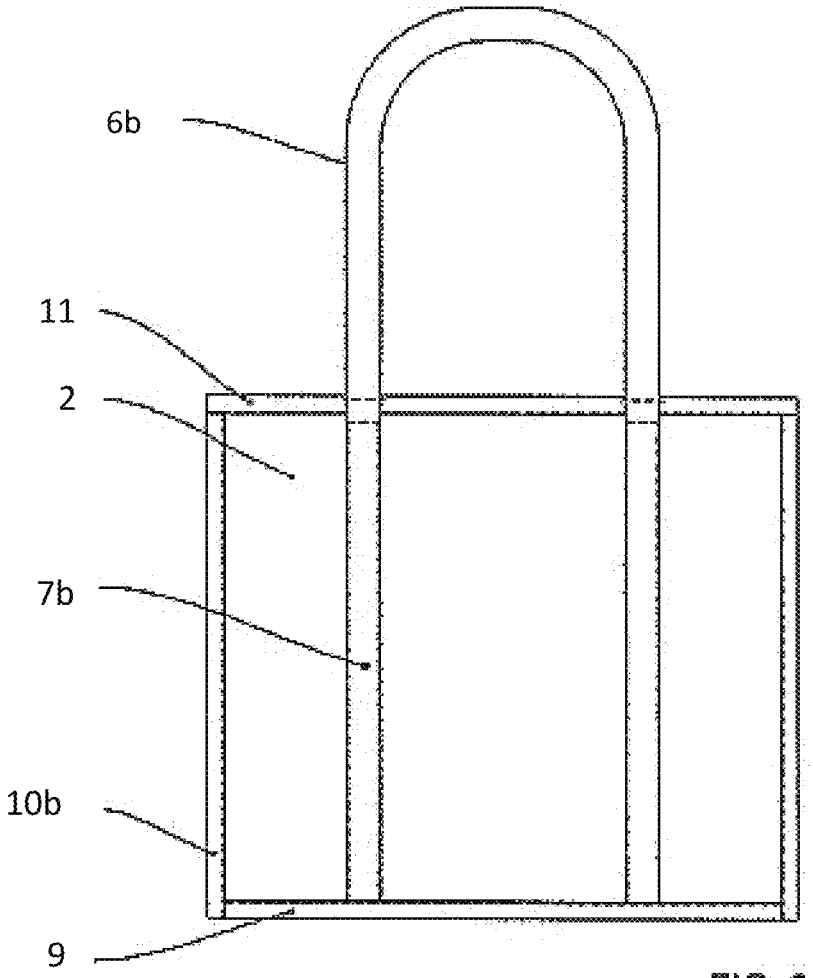
FIG. 6 is a back view of the reversible and expandable handbag showing no pockets, without at least one pocket on the back panel.
Figure 7:
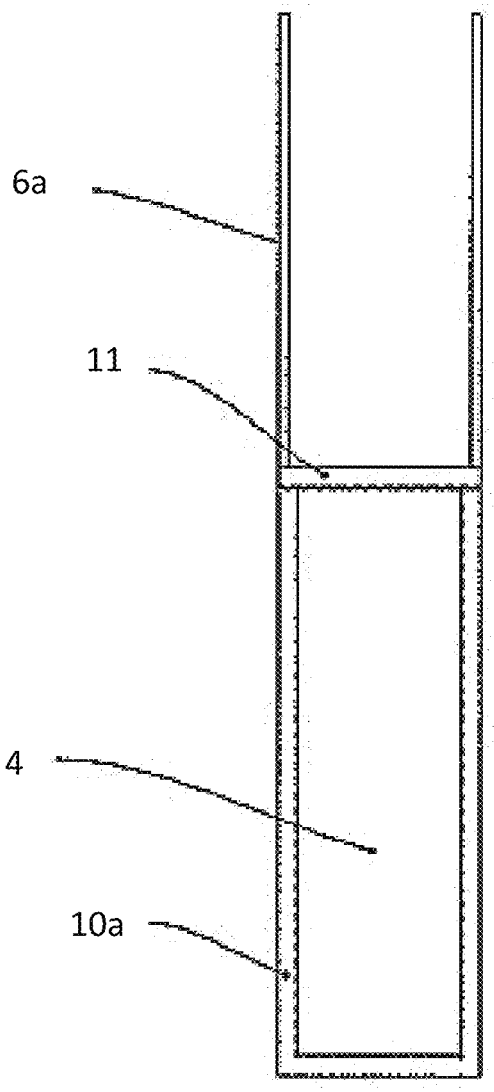
FIG. 7 shows a lateral view of the reversible and expandable handbag.

FIG. 5 shows the handbag 101 wherein the at least one front pocket 5 formed by a single cross-sewn panel across the front panel 1 and/or back panel 2, which, when the extended portions 7*a* and 7*b* of the handle straps 6*a* and 6*b* are sewn lengthwise to the front panel 1 and/or back panel 2, forms the divisions of the at least one outer pocket 5. FIG. 6 shows the handbag 101 without the at least one front pocket 5 on the front panel 1 and/or back panel 2. FIG. 7 is a lateral view of the handbag 101 showing first lateral panel 4*a*, the top bias 11 and the first lateral bias 10*a*.

Figure 8:
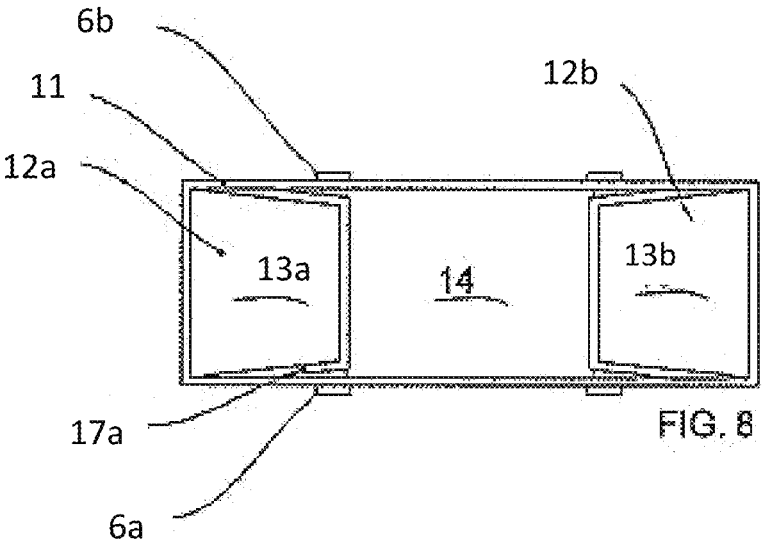
FIG. 8 shows a top view of the reversible and expandable handbag with lateral inner pockets.
Figure 9:
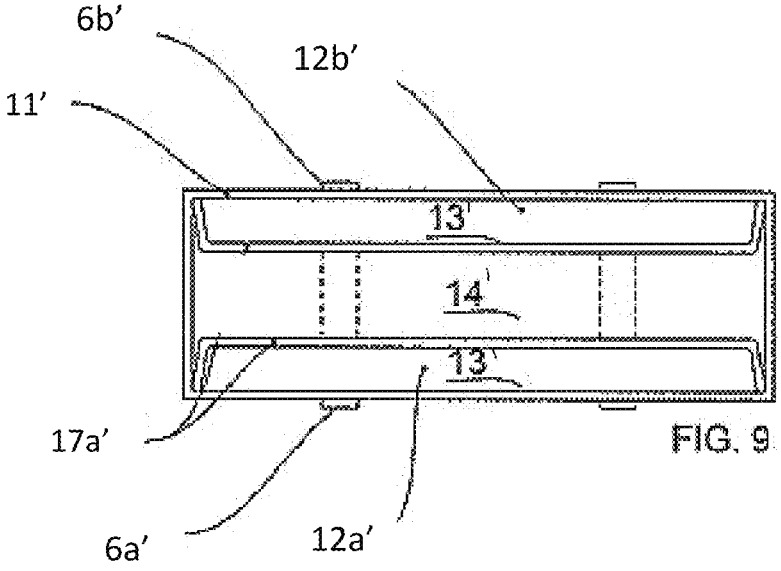
FIG. 9 shows a top view of the reversible and expandable handbag with panel inner pockets.
Figure 10:
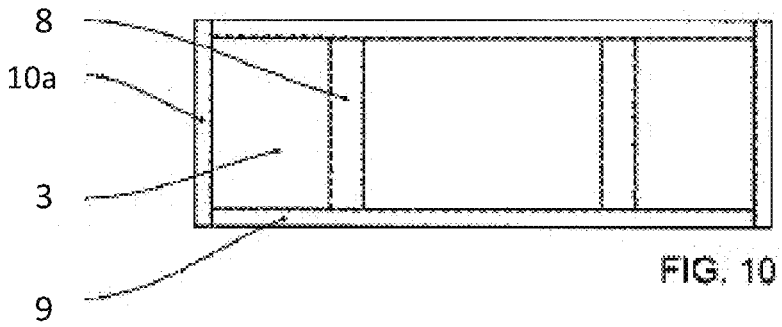
FIG. 10 shows a bottom view of the reversible and expandable handbag.

FIG. 8 is a top view of the handbag 101 showing the inner pockets 12*a* and 12*b*. As shown in FIG. 8, the first inner pocket 12*a* includes an interior space 13*a* and the second inner pocket 12*b* includes an interior space 13*b*. FIG. 9 is a top view of the handbag 101' showing the first inner pocket 12*a*' attached or sewn to both the first and second vertical sides of the front panel 1' and the second inner pocket 12*b*' attached or sewn to both the first and second vertical sides of the back panel 2'. FIG. 10 is a bottom view of the handbag 101 showing the reinforcement strap 8.

Figure 11:
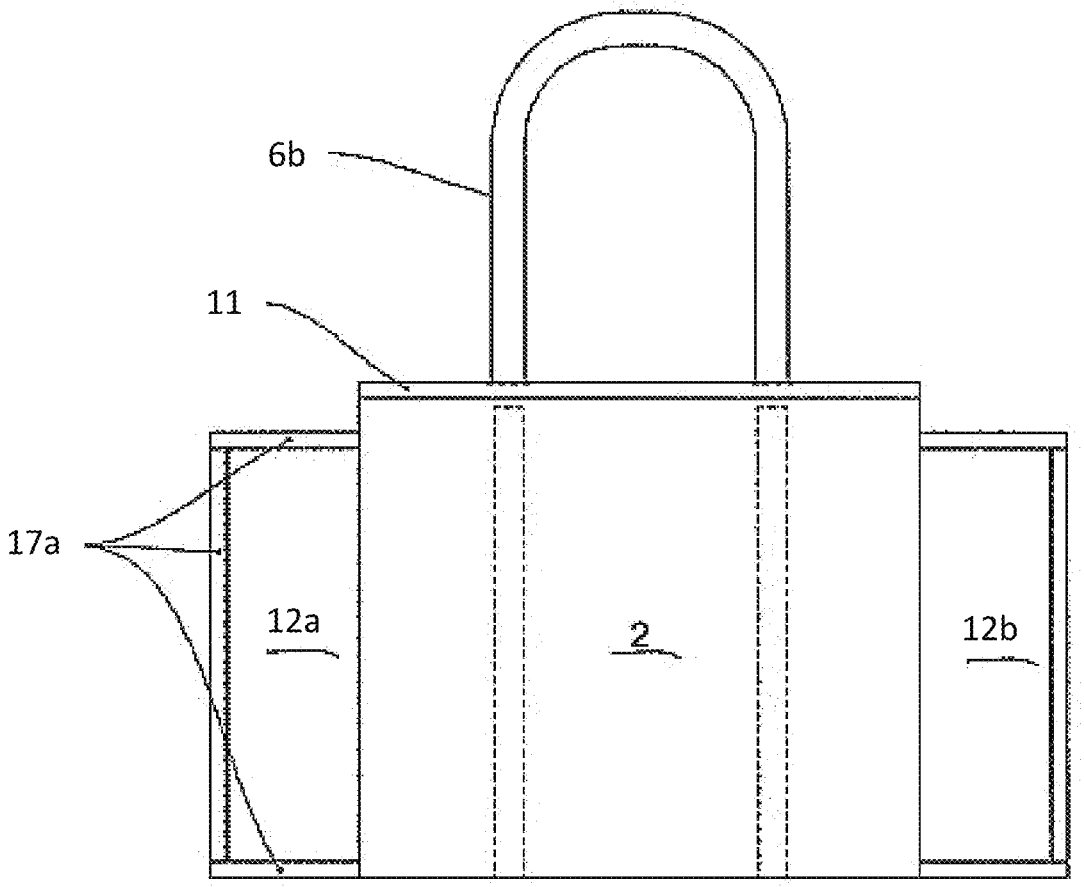
FIG. 11 shows a front and back view of the reversible and expandable handbag with lateral inner pockets, in its reversible expandable configuration.
Figure 12:
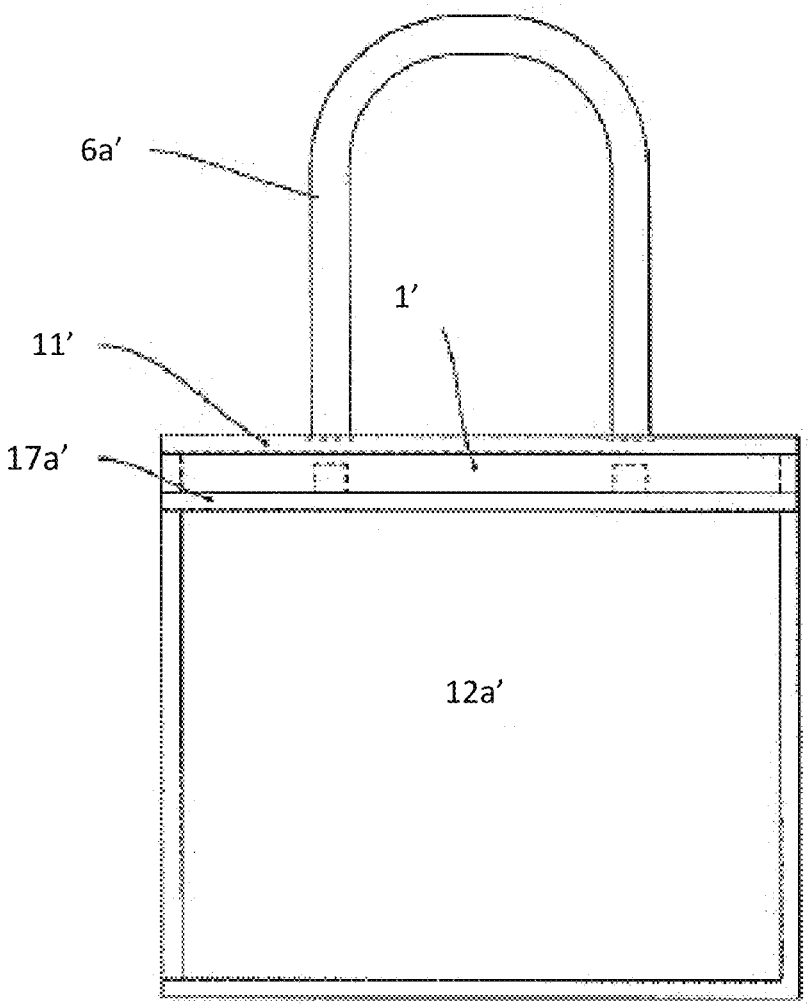
FIG. 12 shows a front and back view of the back of the reversible and expandable handbag with panel inner pockets, in its reversible expandable configuration.
Figure 13:
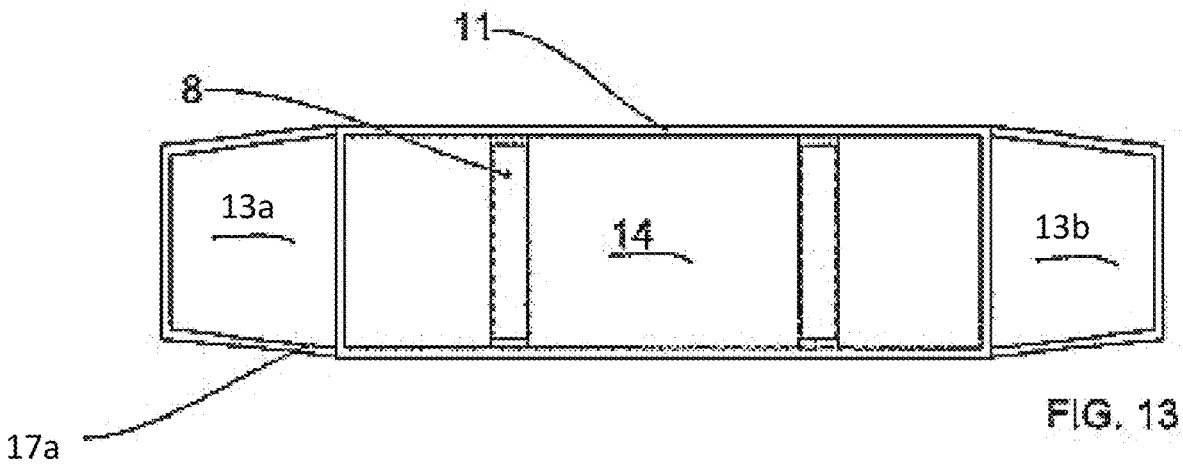
FIG. 13 shows a top view of the reversible and expandable handbag with lateral inner pockets, in its reversible expandable configuration.
Figure 14:
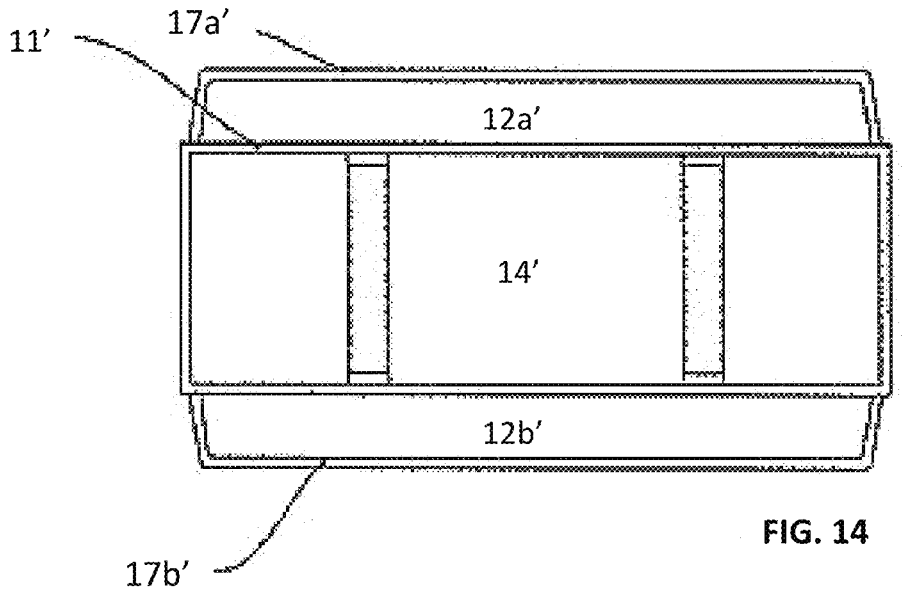
FIG. 14 shows a top view of the reversible and expandable handbag with panel inner pockets, in its reversible expandable configuration.

FIG. 11 is a front view of the handbag 101 in its reversible and expandable configuration. FIG. 12 is also a front view of the handbag 101' in its reversible and expandable configuration but the first inner pocket 12*a*' is attached or sewn to both the first and second vertical sides of the front panel 1' and the second inner pocket 12*b*' is attached or sewn to both the first and second vertical sides of the back panel 2'. Similarly, FIG. 13 is top view of the handbag 101 in its reversible and expandable configuration; whereas FIG. 14 is top view of the handbag 101' in its reversible and expandable configuration wherein the first inner pocket 12*a*' is attached or sewn to both the first and second vertical sides of the front panel 1' and the second inner pocket 12*b*' is attached or sewn to both the first and second vertical sides of the back panel 2'.

Figure 15:
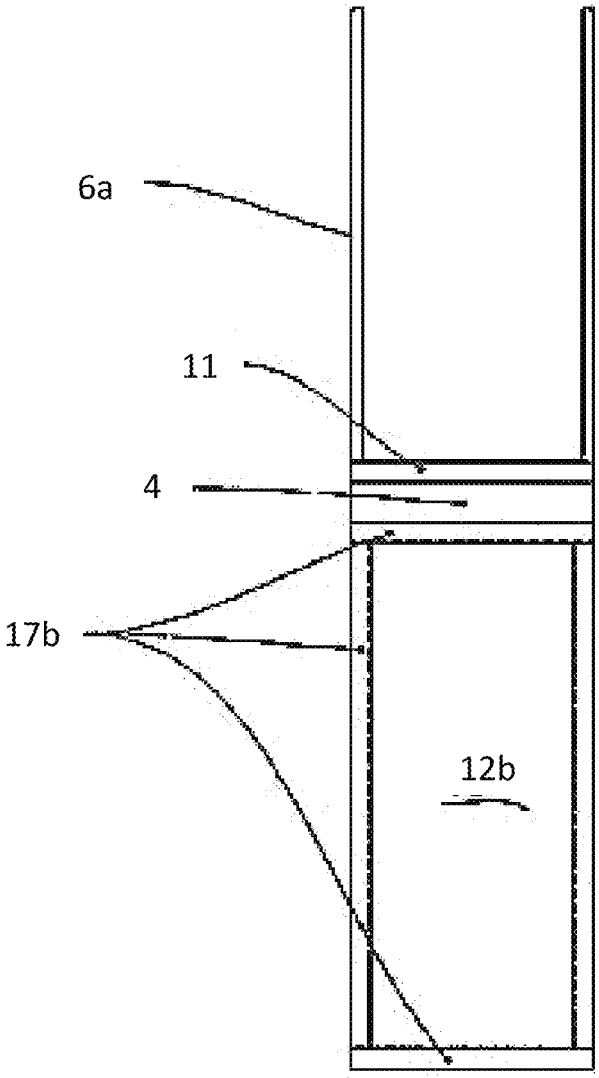
FIG. 15 shows a lateral view of the reversible and expandable handbag with lateral inner pockets, in its reversible expandable configuration.
Figure 16:
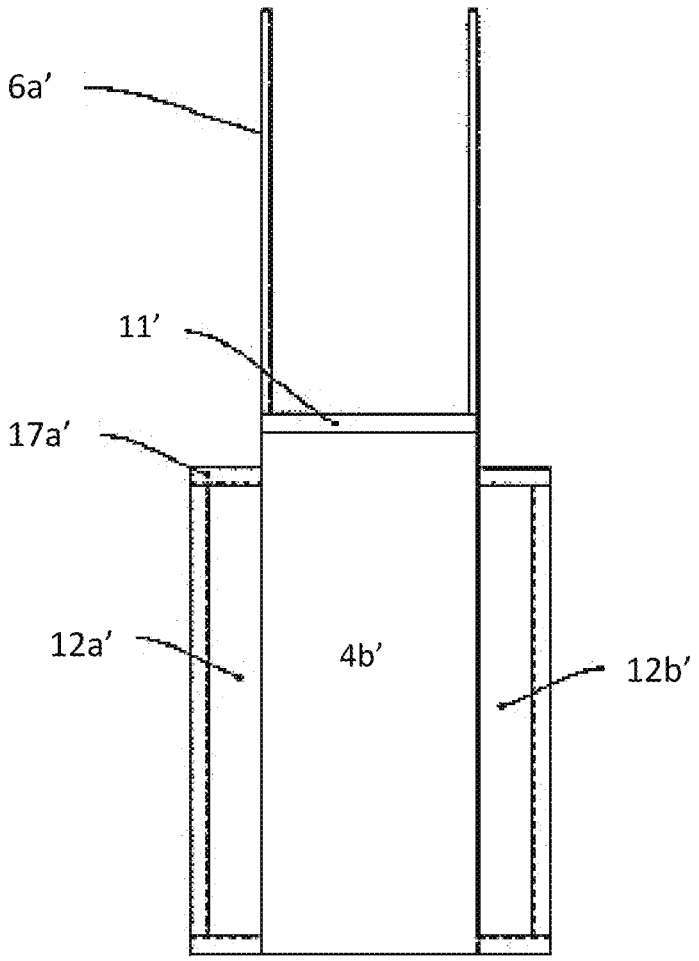
FIG. 16 shows a lateral view of the reversible and expandable handbag with panel inner pockets, in its reversible expandable configuration.
Figure 17:
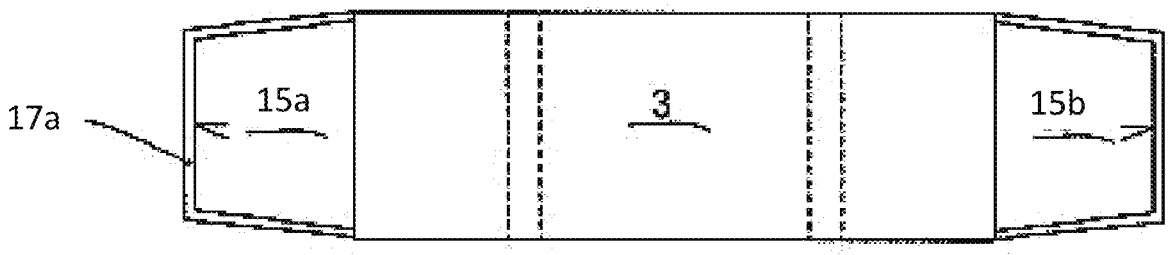
FIG. 17 shows a bottom view of the reversible and expandable handbag with lateral inner pockets, in its reversible expandable configuration.
Figure 18:
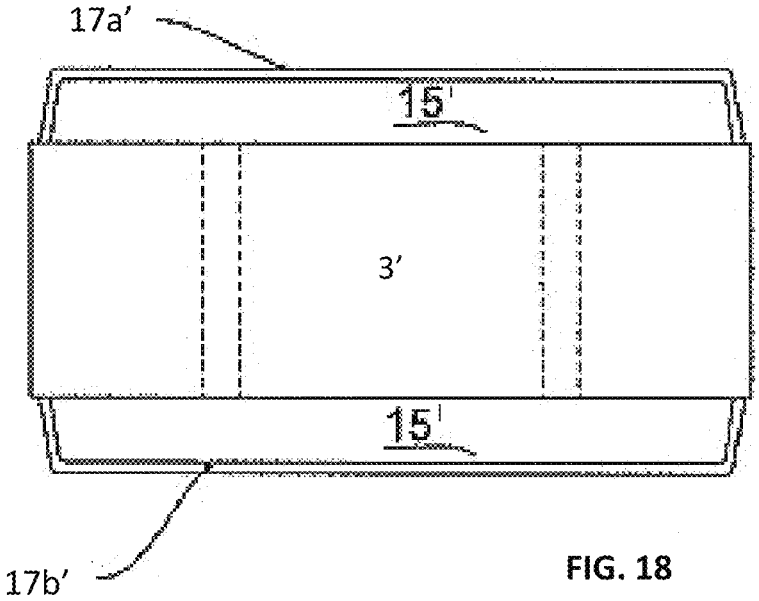
FIG. 18 shows a bottom view of the reversible and expandable handbag with panel inner pockets, in its reversible expandable configuration.

FIG. 15 is a lateral view of the handbag 101 in its reversible and expandable configuration. FIG. 16 is also a lateral view of the handbag 101' in its reversible and expandable configuration but the first inner pocket 12*a*' is attached or sewn to both the first and second vertical sides of the front panel 1' and the second inner pocket 12*b*' is attached or sewn to both the first and second vertical sides of the back panel 2'. FIG. 17 is a bottom view of the of the handbag 101 in its reversible and expandable configuration; whereas FIG. 18 is a bottom view of the handbag 101' in its reversible and expandable configuration showing the bottom panel 3', the bottom ends 15*a*', 15*b*' and the biases 17*a*', 17*b*' that surround the first and second inner pockets 12*a*' and 12*b*' respectively. It should be noted that the first inner pocket 12*a*' is attached or sewn to both the first and second vertical sides of the front panel 1' and the second inner pocket 12*b*' is attached or sewn to both the first and second vertical sides of the back panel 2'.

Figure 19:
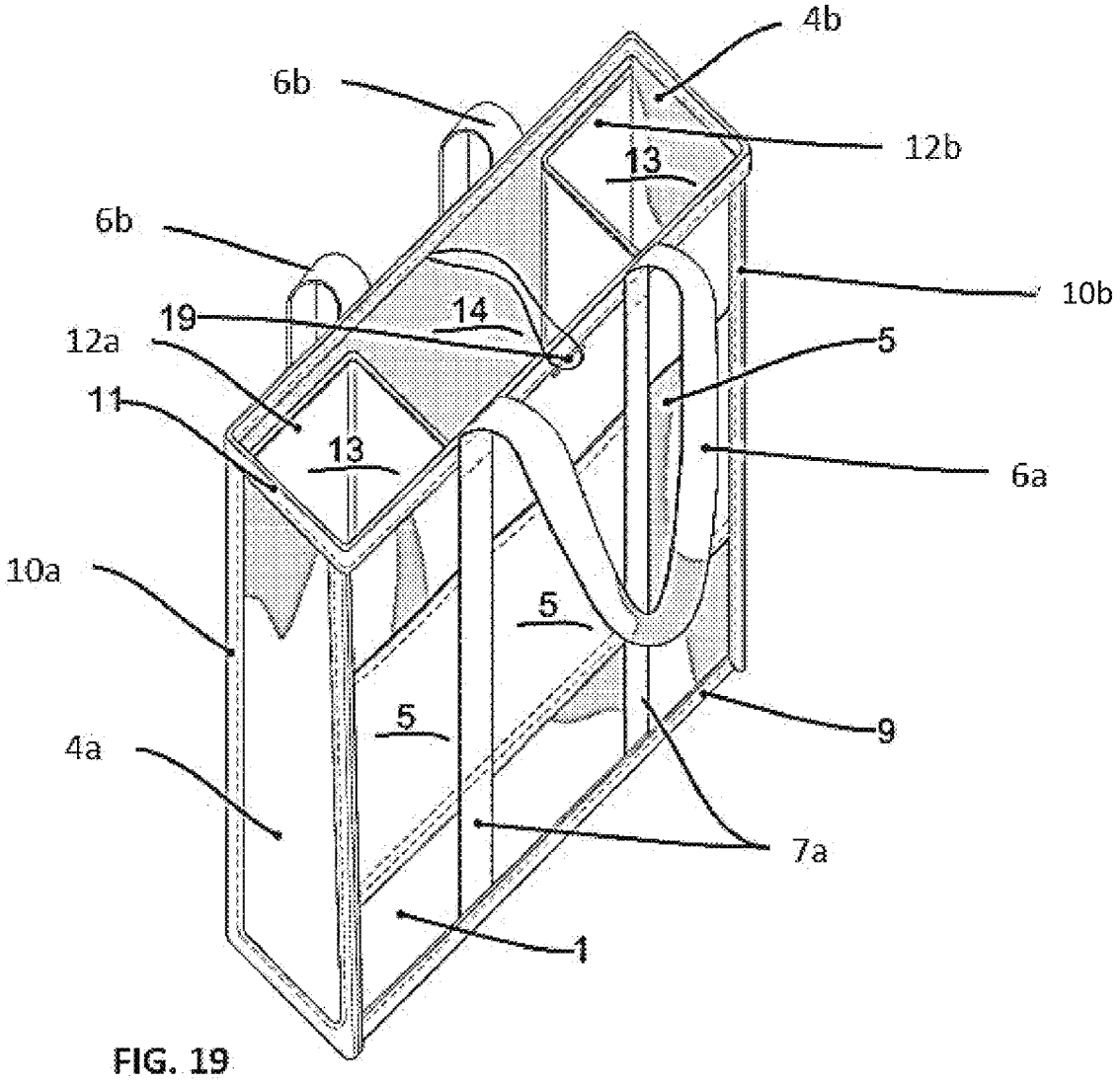
FIG. 19 shows a perspective view of the reversible and expandable handbag with a toggle clasp top closure.
Figure 20:
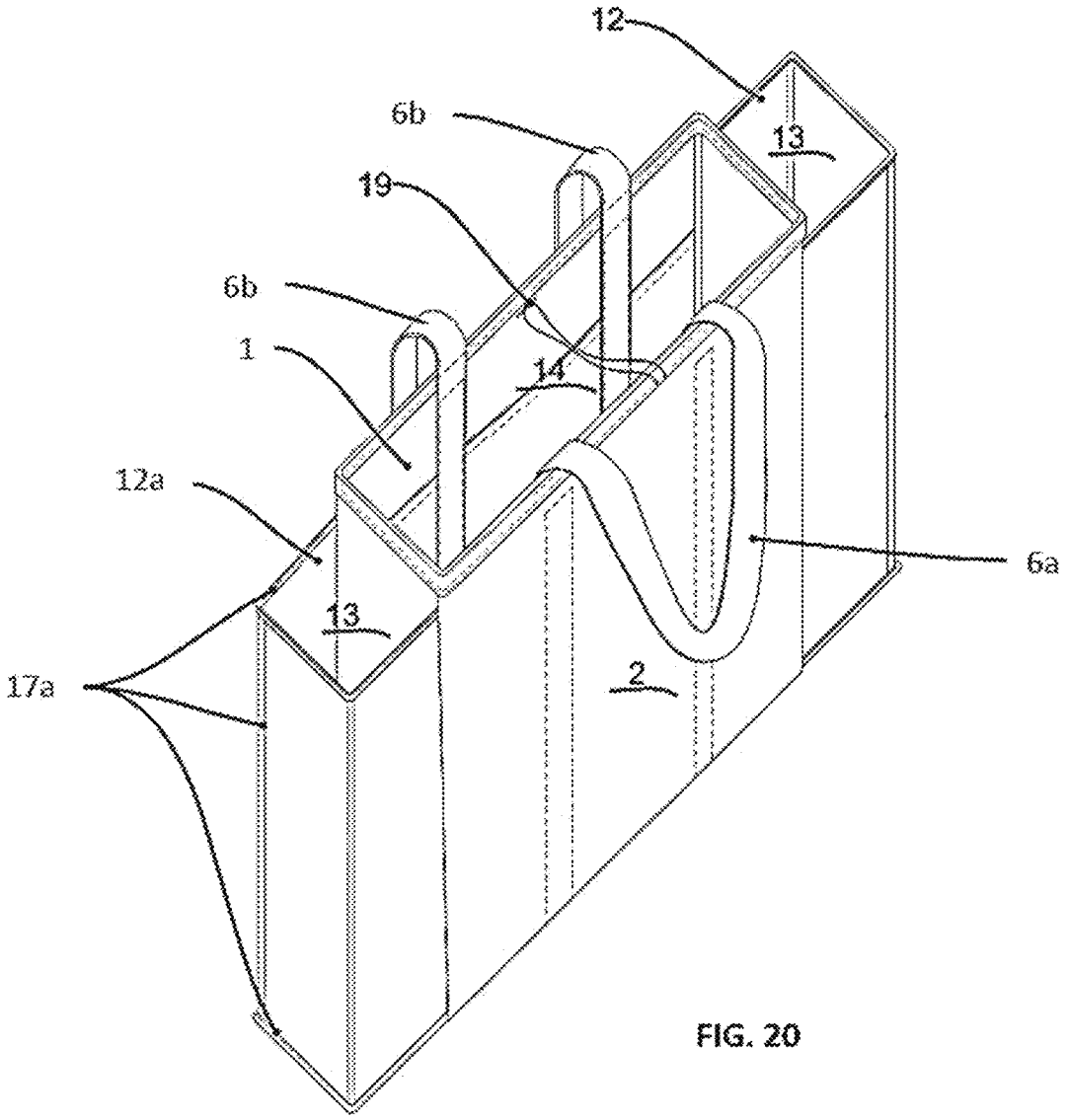
FIG. 20 shows a perspective view of the reversible and expandable handbag with a toggle clasp top closure, in its reversible expandable configuration.
Figure 21:
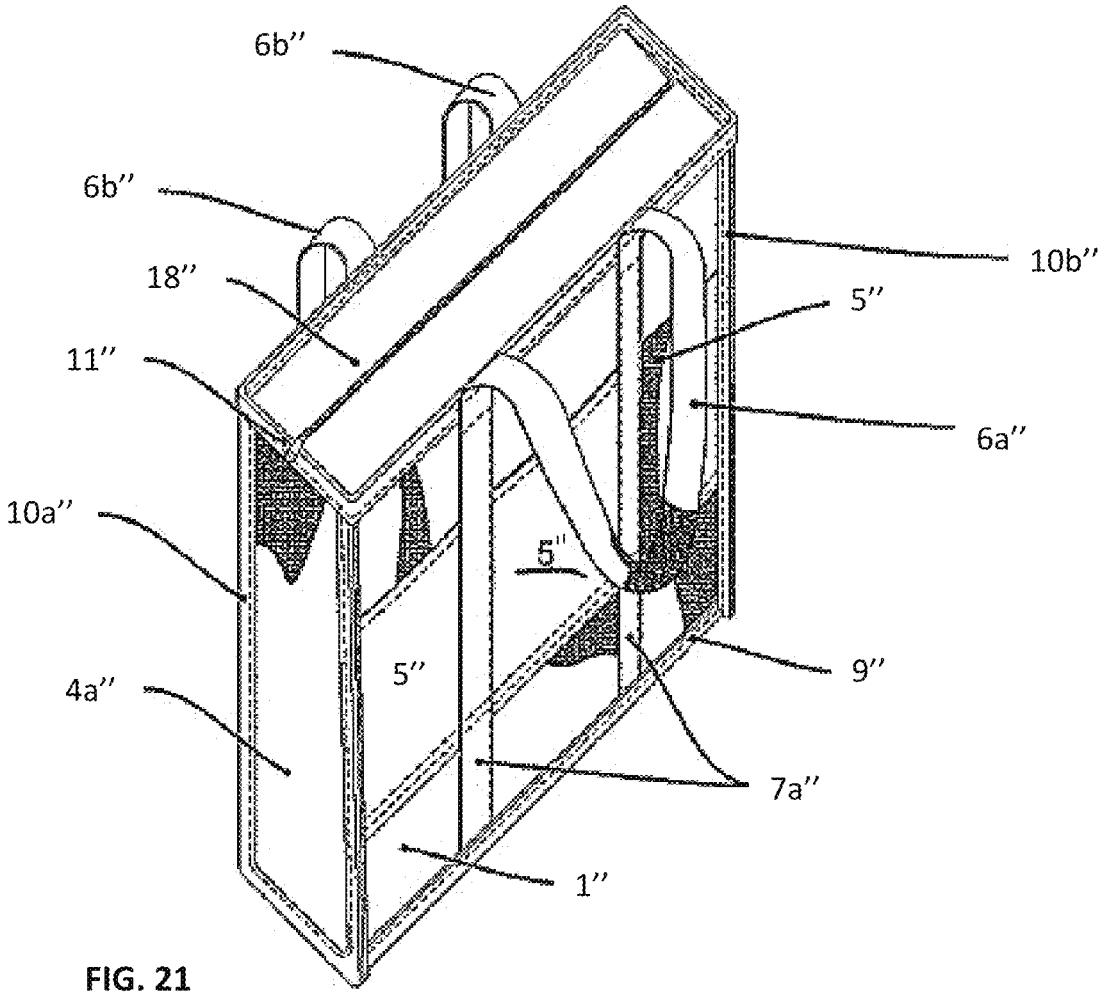
FIG. 21 shows a perspective view of the reversible and expandable handbag with an open-end zipper top closure.
Figure 22:
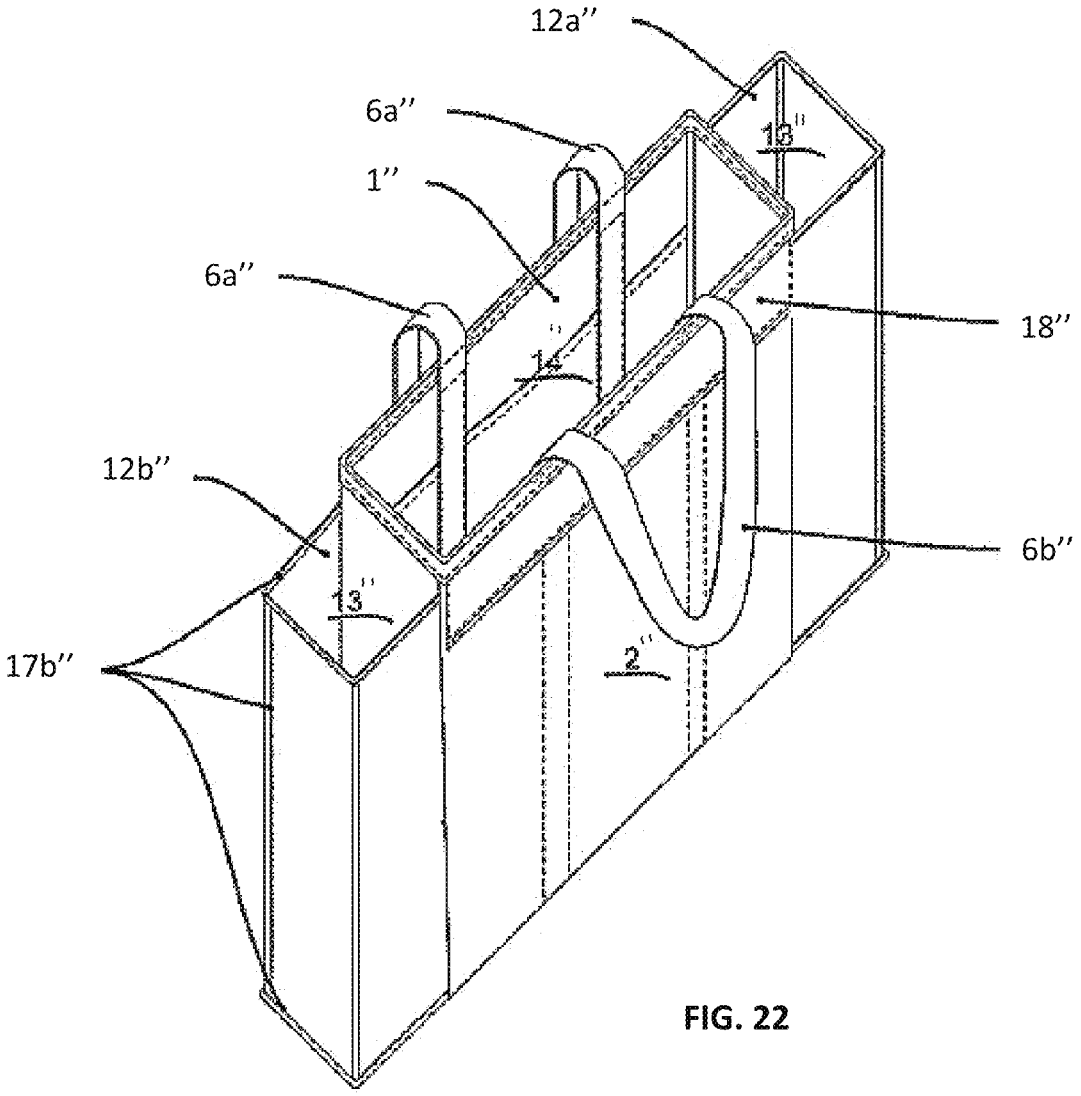
FIG. 22 shows a perspective view of the reversible and expandable handbag with an open-end zipper top closure, in its reversible expandable configuration.

FIG. 19 is a perspective view of the handbag 101 further comprising a toggle clasp top closure 19. FIG. 20 is a perspective view of the handbag 101 in FIG. 19, but in its reversible and expandable configuration. FIG. 21 is also a perspective view of the handbag 101 further comprising an open-end zipper top closure 18. FIG. 22 is a perspective view of the handbag 101 in FIG. 21, but in its reversible and expandable configuration. It should be noted that the embodiment shown in FIGS. 21-22 includes elements that are analogous to those described in FIGS. 1-2. These analogous elements have been identified with the same reference numeral as those in FIGS. 1-2, except that the reference numerals in FIGS. 21-22 also have two apostrophes right next to each reference numeral to distinguish them from the ones in FIGS. 1-2.

Figure 23A:
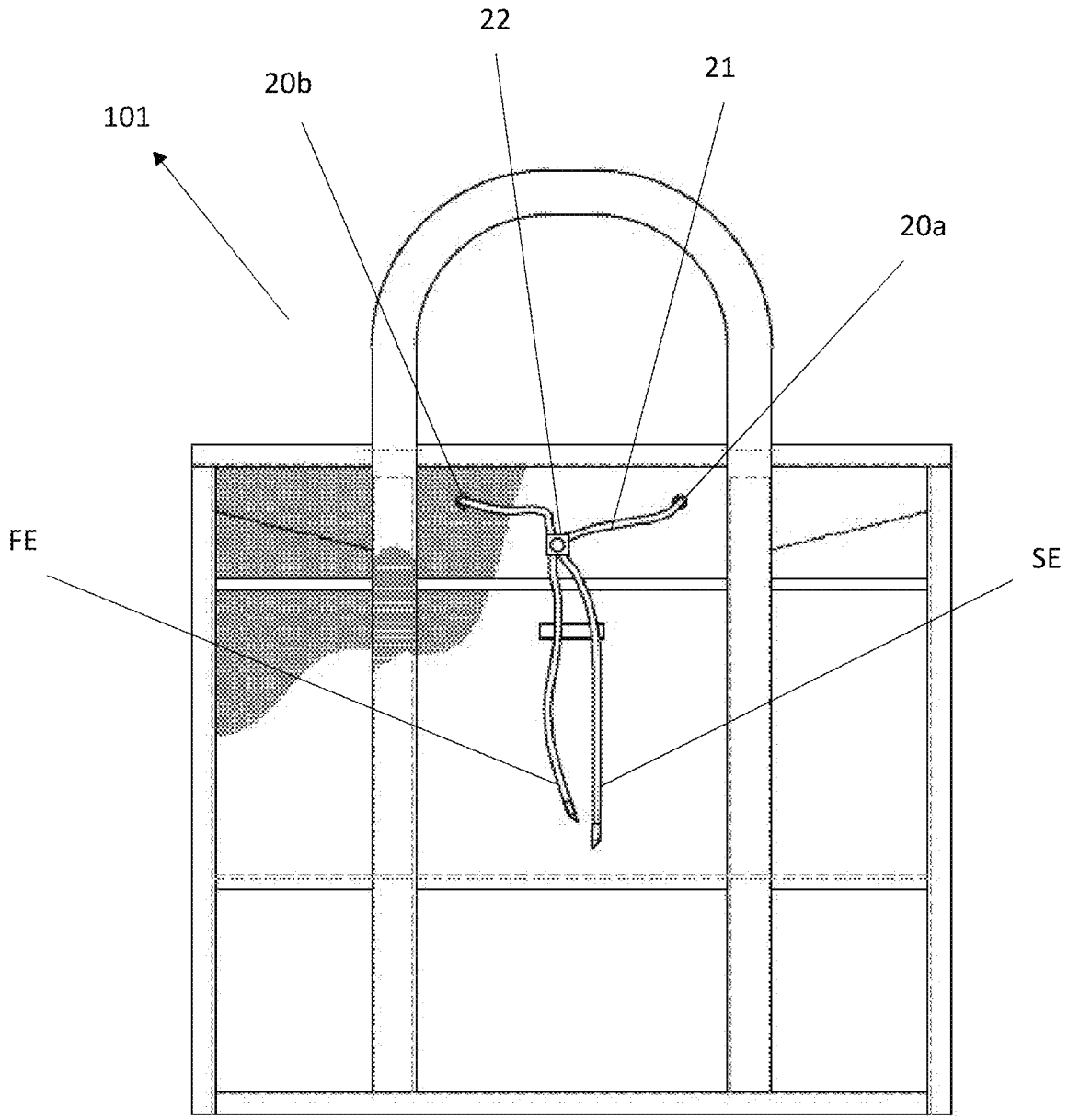
FIG. 23A shows a front view of the reversible and expandable handbag with a closing mechanism.
Figure 23B:
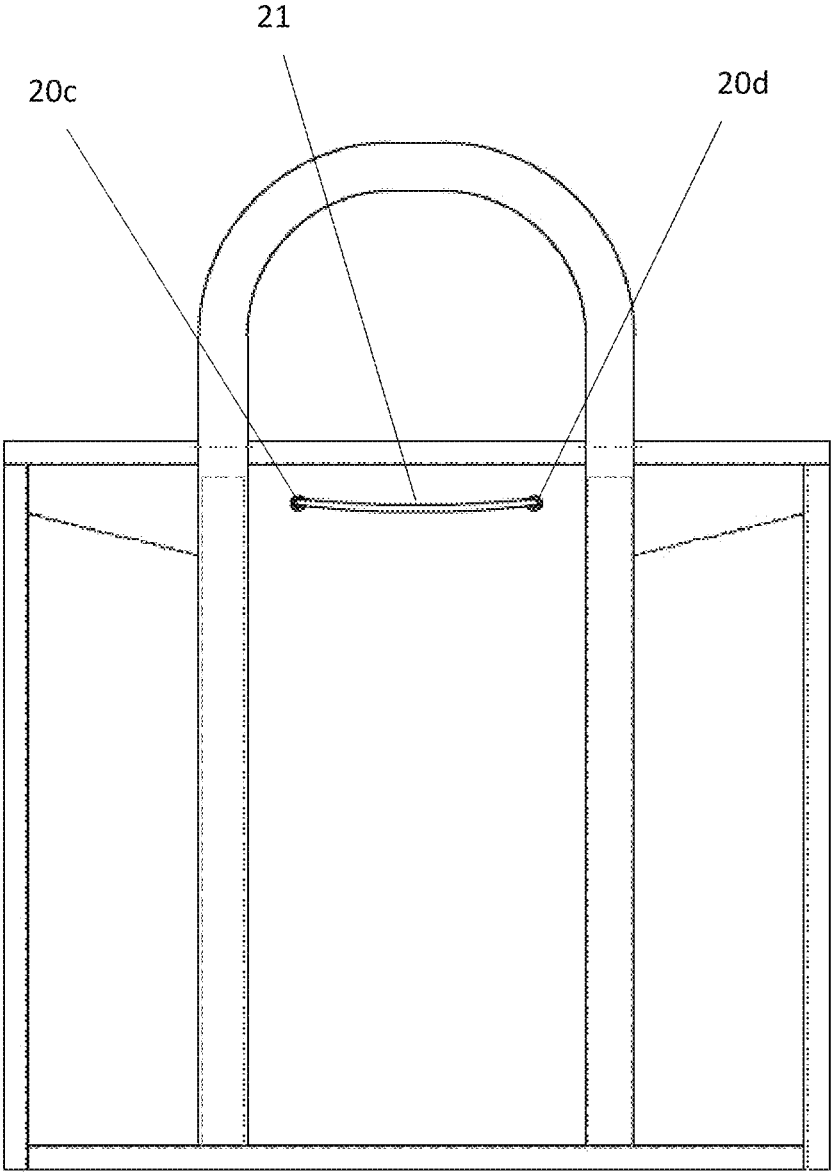
FIG. 23B shows a rear view of the reversible and expandable handbag with a closing mechanism.
Figure 23C:
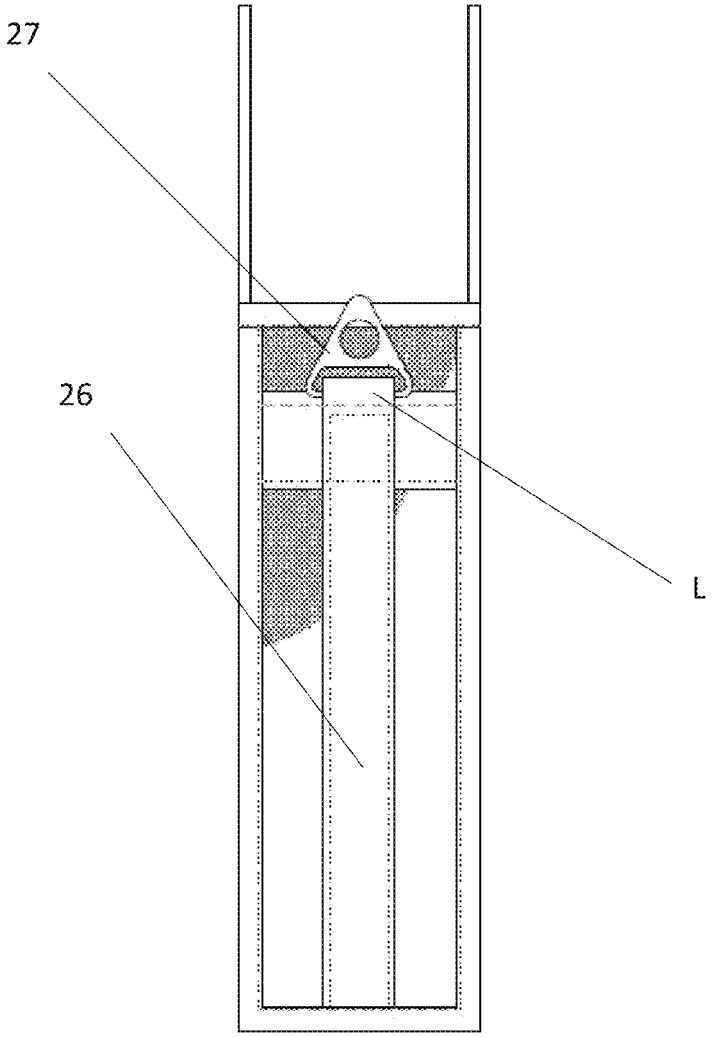
FIG. 23C shows a lateral view of the reversible and expandable handbag with a closing mechanism.
Figure 23D:
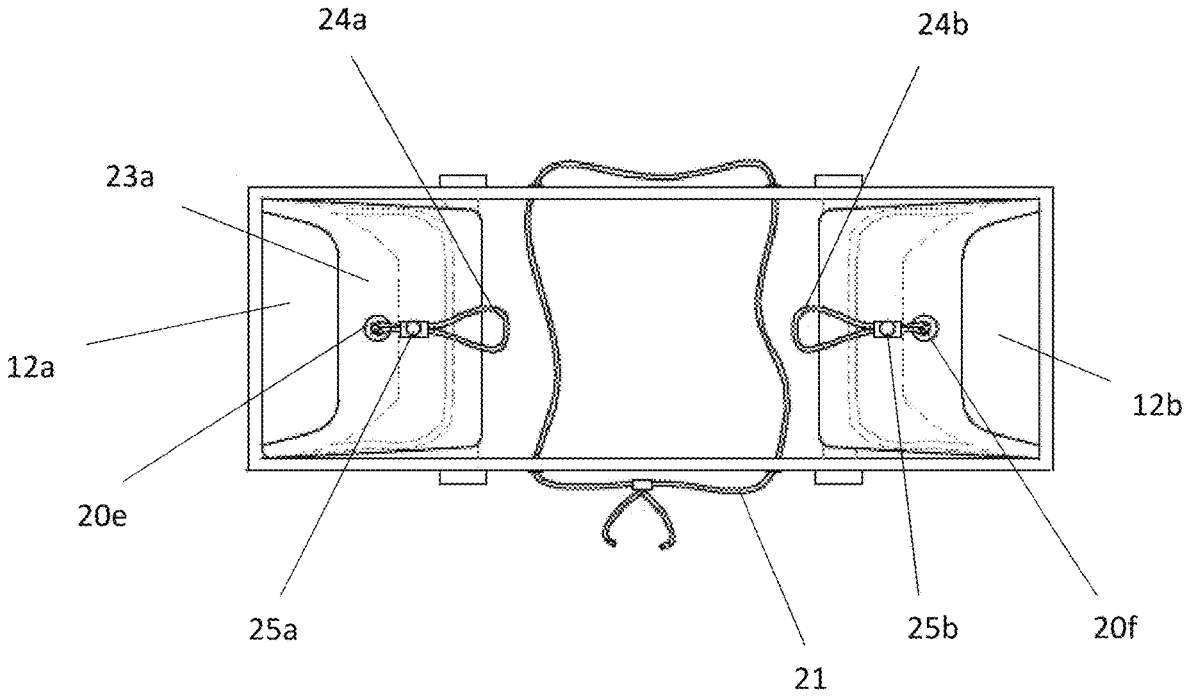
FIG. 23D shows a top view of the reversible and expandable handbag with a closing mechanism.
Figure 23E:
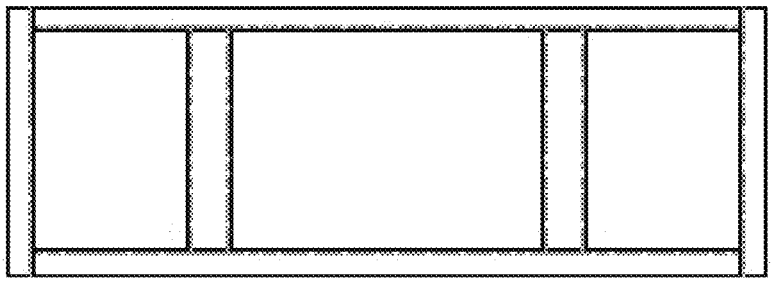
FIG. 23E shows a bottom view of the reversible and expandable handbag with a closing mechanism.
Figure 23F:
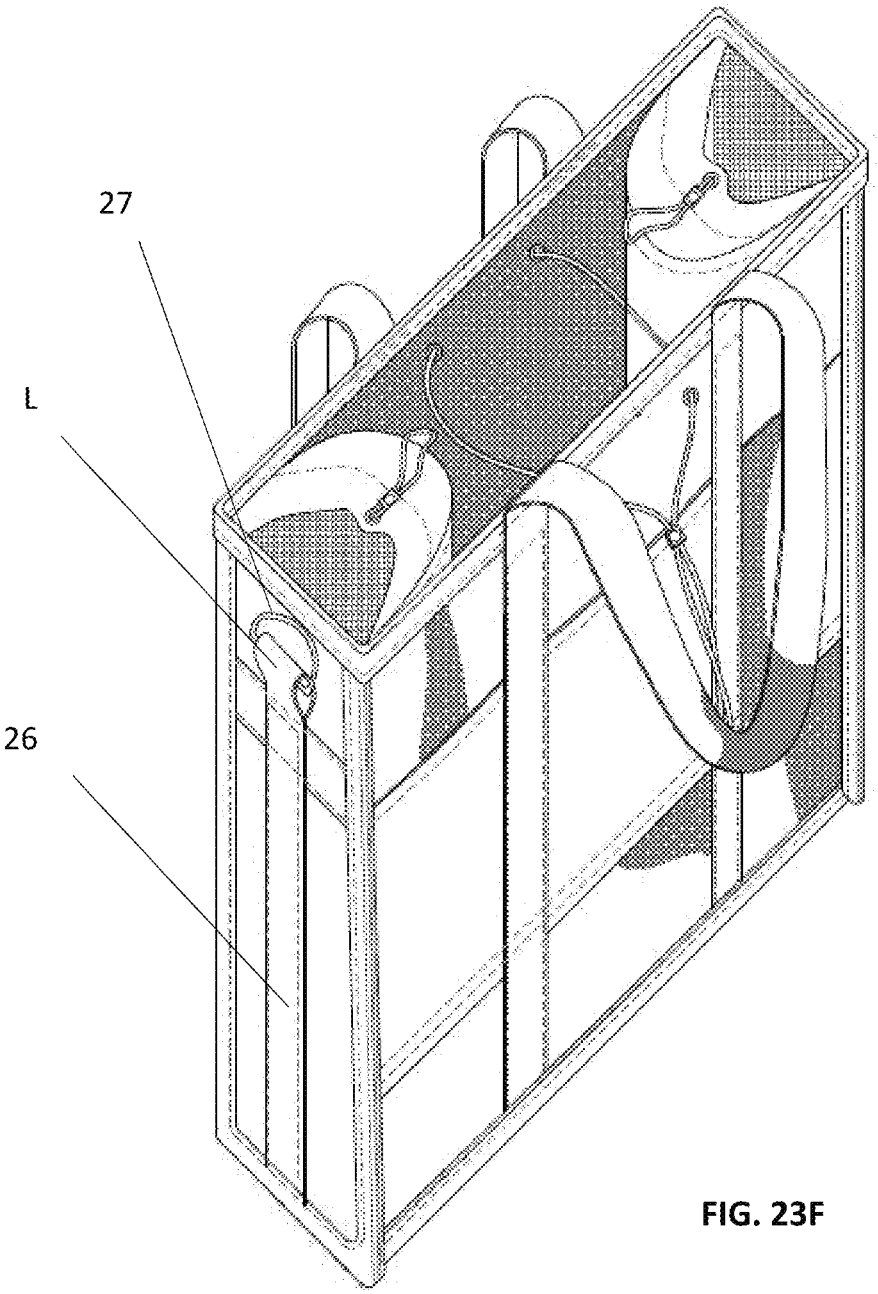
FIG. 23F shows a perspective view of the reversible and expandable handbag with a closing mechanism.
Figure 24A:
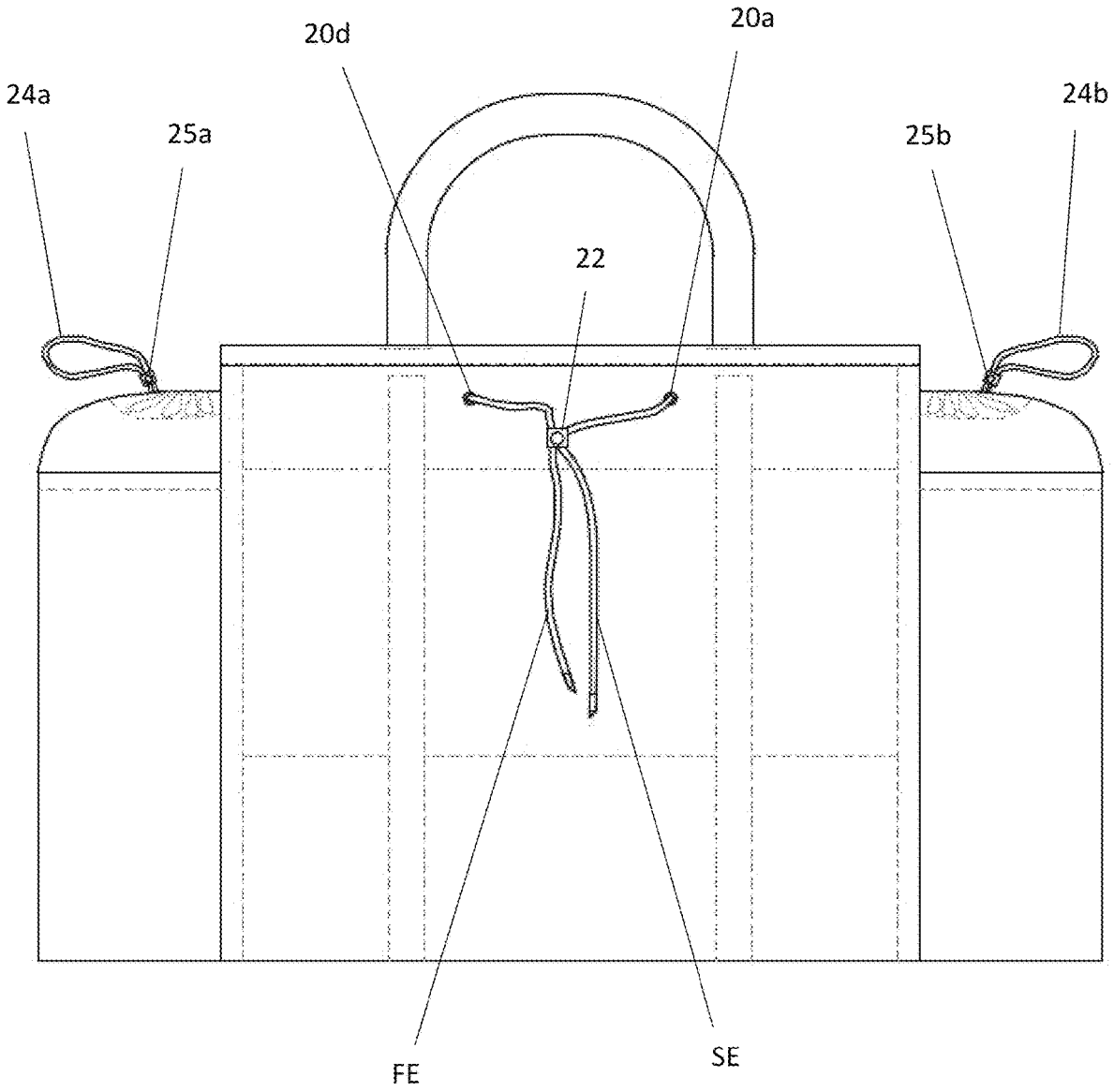
FIG. 24A shows a front view of the reversible and expandable handbag with a closing mechanism, in its reversible expandable configuration.
Figure 24B:
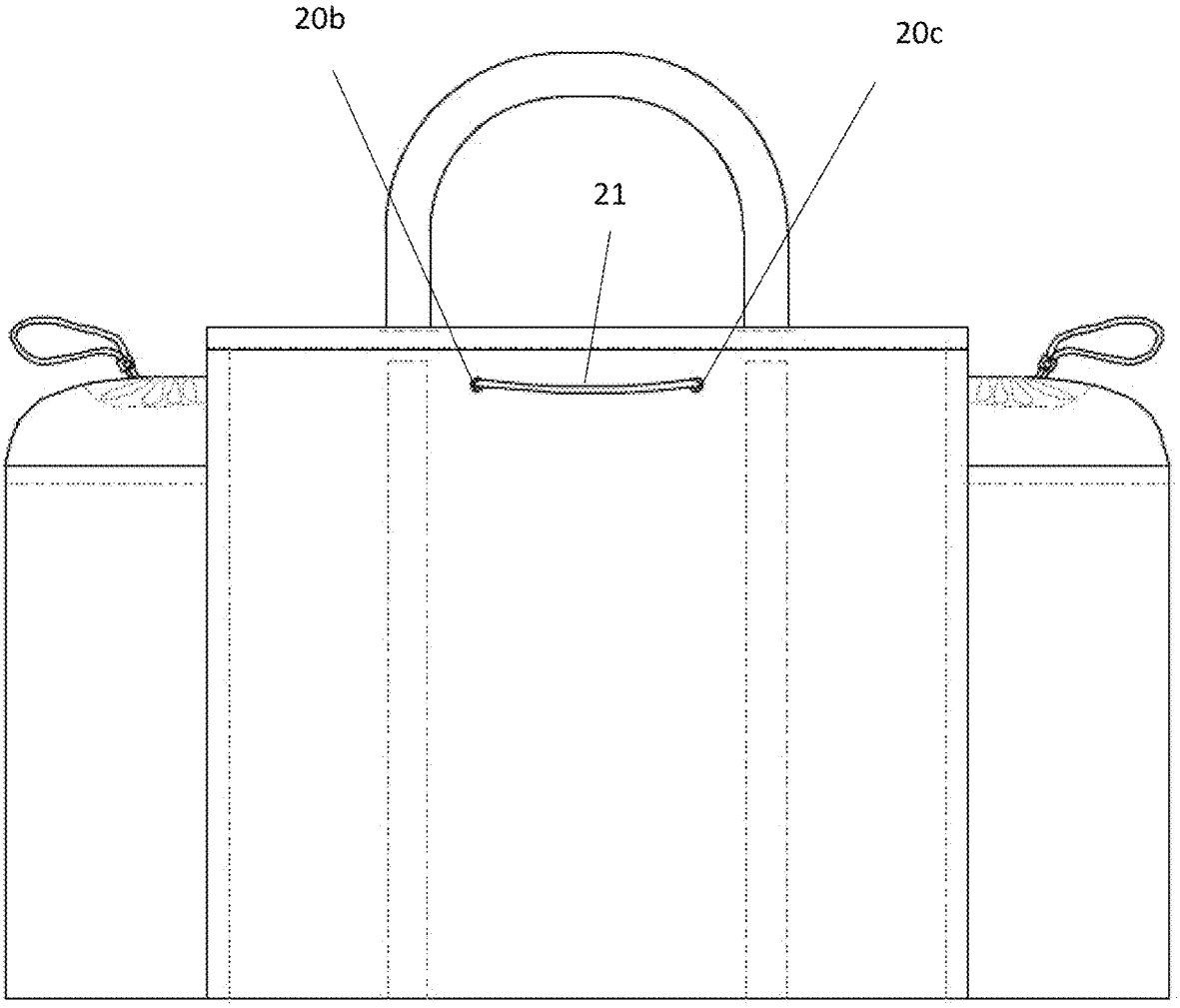
FIG. 24B shows a rear view of the reversible and expandable handbag with a closing mechanism, in its reversible expandable configuration.
Figure 24C:
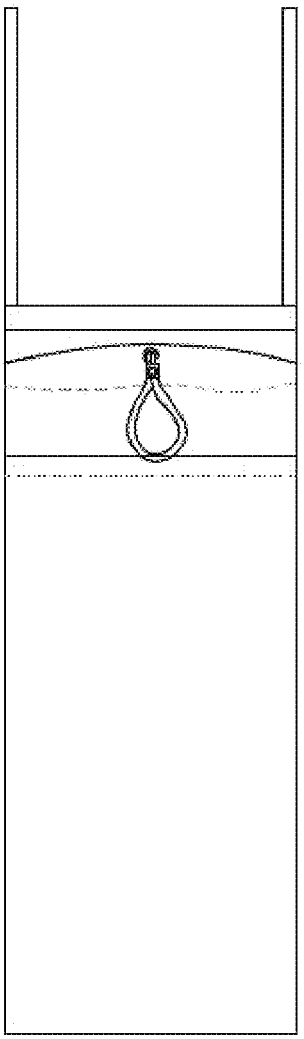
FIG. 24C shows a lateral view of the reversible and expandable handbag with a closing mechanism, in its reversible expandable configuration.
Figure 24D:
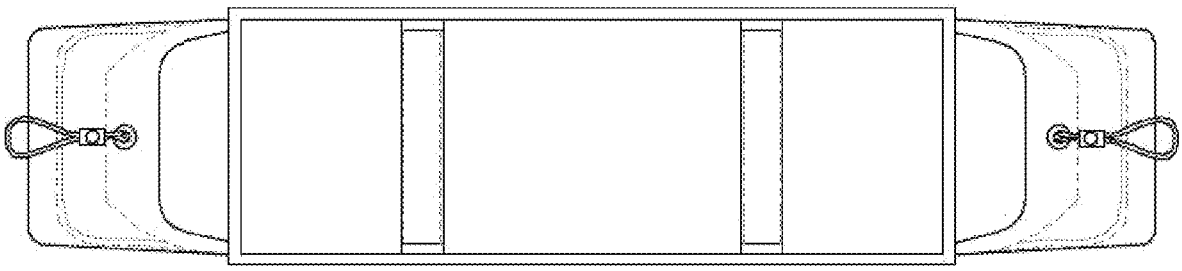
FIG. 24D shows a top view of the reversible and expandable handbag with a closing mechanism, in its reversible expandable configuration.
Figure 24E:
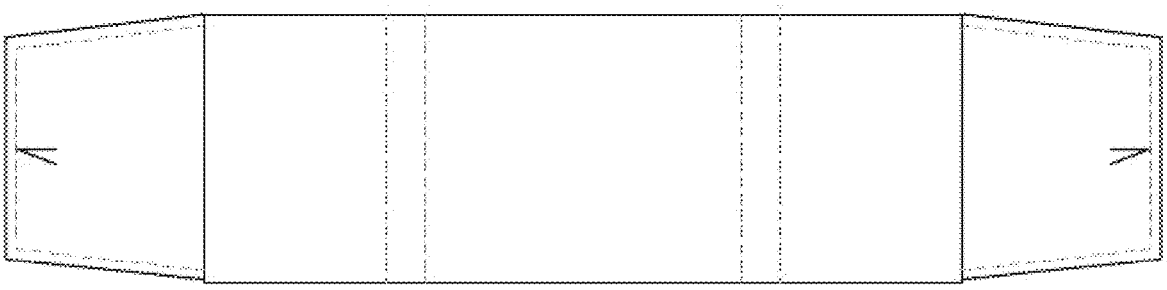
FIG. 24E shows a bottom view of the reversible and expandable handbag with a closing mechanism, in its reversible expandable configuration.
Figure 24F:
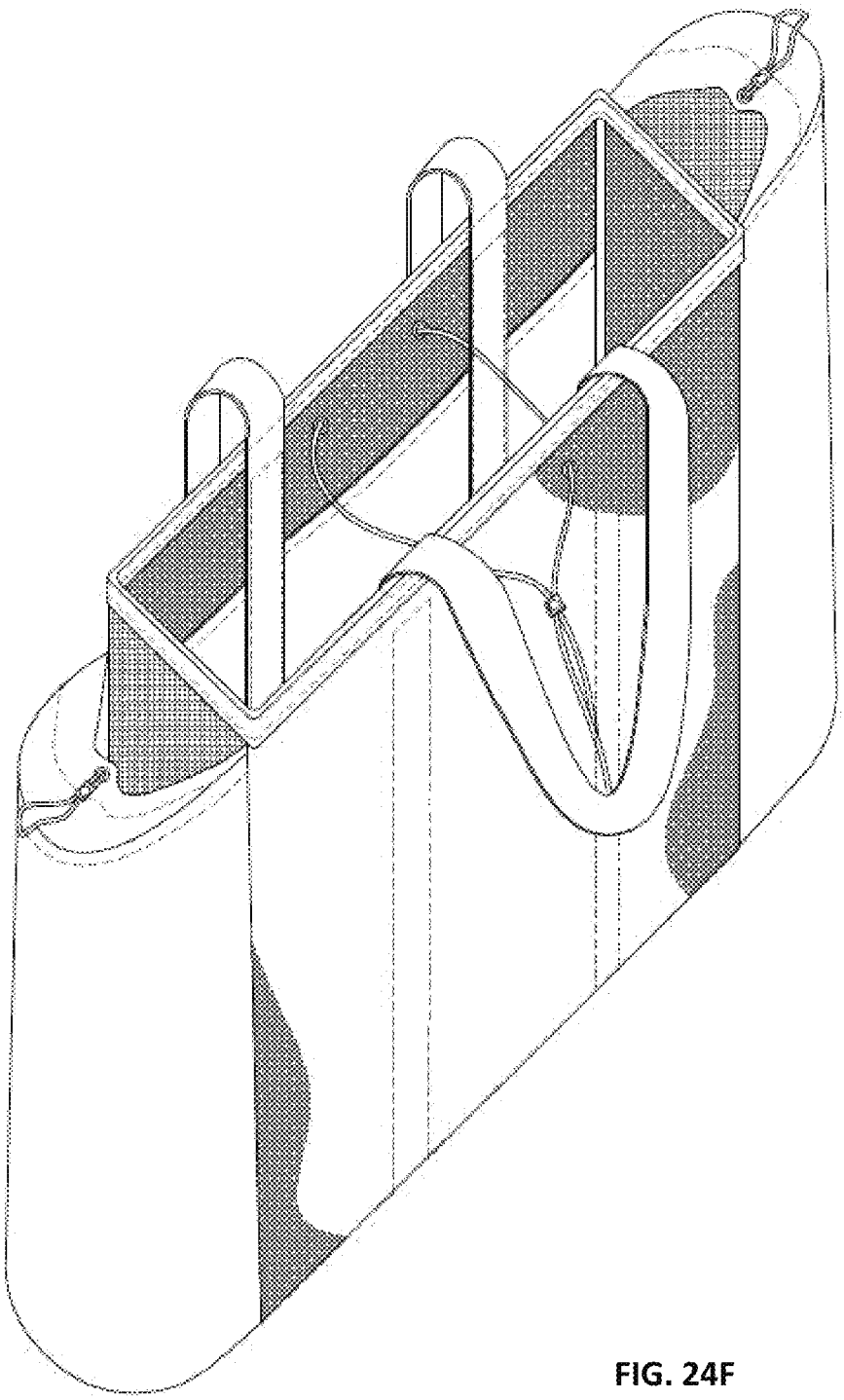
FIG. 24F shows a perspective view of the reversible and expandable handbag with a closing mechanism, in its reversible expandable configuration.
Figure 25:
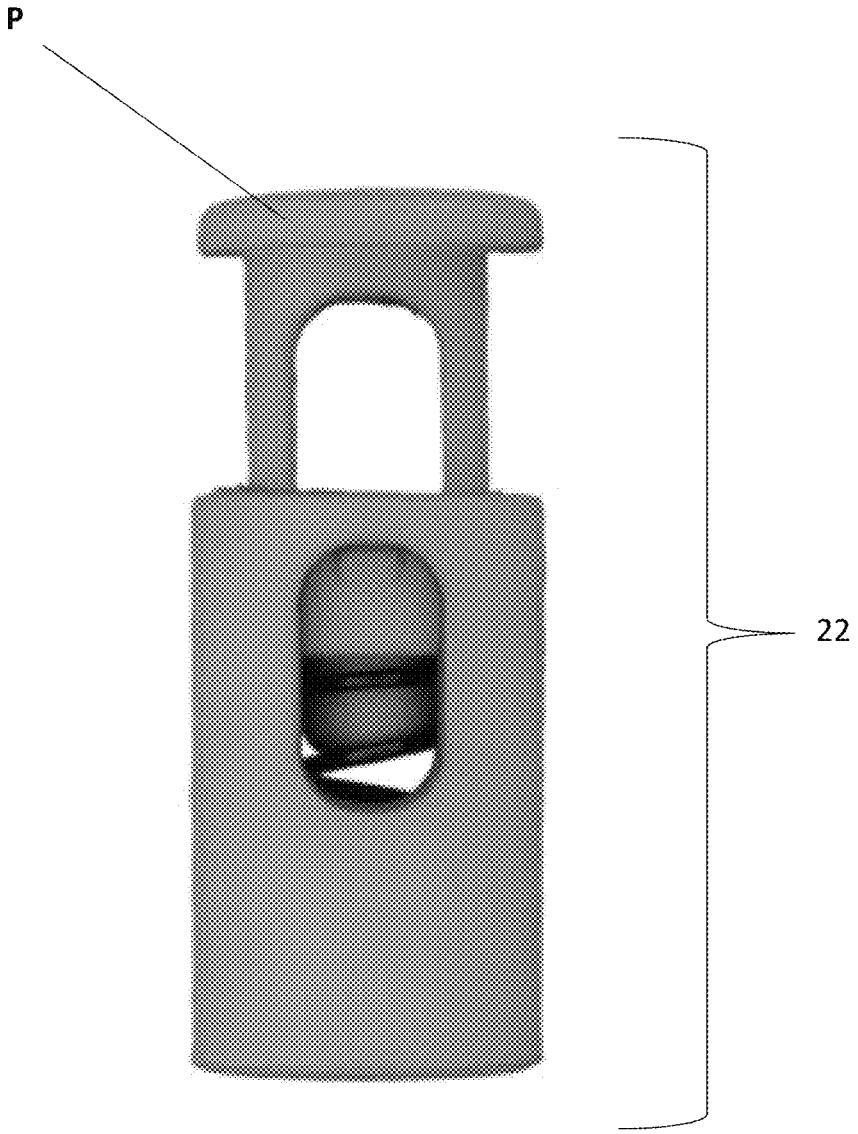
FIG. 25 shows a cord lock or stopper used as part of the closing mechanism for the reversible and expandable handbag.

As shown in FIGS. 23A-E and 24A-E, the handbag 101 may also include a closing mechanism to restrict access into the interior 14 of the handbag 101. Particularly, the front panel 1 and back panel 2 of the handbag 101 may include one or more eyelets or grommets 20*a*, 20*b*, 20*c*, 20*d* configured to receive a cord or lace 21 having a first end FE and a second end SE. The one or more eyelets 20*a*, 20*b* on the front panel 1 should preferably align with the one or more eyelets 20*c*, 20*d* on the second panel 2, as shown in FIGS. 23D and 23F. The eyelet 20*a* is configured to receive the first end FE of the cord 21 on the front panel 1; the cord 21 is then introduced through eyelet 20*c* on the back panel; subsequently through eyelet 20*d* on the back panel 2 and lastly through eyelet 20*b* on the front panel 1. Once the cord has been introduced through all eyelets 20*a*, 20*b*, 20*c*, 20*d* on the front and back panels, the first end FE and second end SE of the cord 21 are then introduced through a cord lock or stopper 22, which, in turn, is configured to interact with the cord 21, in order to open and close the handbag 101. Cord locks are well-known in the art, and it refers to lock that holds a cord in place. As shown in FIG. 25, cord locks are often cylinder-shaped with an end that is pushed in to release the cord and allow it to move. Cord locks typically have a hole on the side of the lock where a spring is visible. There is also a hole in the top button, or plunger P. When the plunger P is depressed, the holes on the barrel of the lock and on the plunger align, allowing the cord to move. But once the plunger P is released, the holes are not aligned anymore and the mechanism locks back down on the cord so that it is fastened in place. Accordingly, once the first and second ends of the cord 21 have been introduced through the cord lock 22, a user of the handbag 101 can close the handbag 101 by holding the first and second ends FE, SE of the cord 21, depressing the plunger P and pushing the cord lock 22 towards the handbag. Conversely, a user can open the handbag 101 by holding the first and second ends FE, SE of the cord 21, depressing the plunger P, and pulling the cord lock 22 away from the handbag 101.

The inner pockets 12*a*, 12*b* of the handbag 101, may also include a closing mechanism to restrict access into these pockets, as shown in FIGS. 23D, 23F and 24A-F. For this closing mechanism, a first mesh or fabric enclosure 23*a* is sewn to the upper portion of the three vertical panels on the first inner pocket 12*a* and a second mesh or fabric enclosure 23*b* is sewn to the upper portion of the three vertical panels on second inner pocket 12*b*. Moreover, the closing mechanism includes a cord 24*a* having a first and second end respectively sewn to the first and second vertical panels of the first inner pocket 12*a*; and a cord 24*b* having a first and second end respectively sewn to the first and second vertical panels of the second inner pocket 12*b*. Lastly, the third vertical panel on the first inner pocket 12*a* includes an eyelet 20*e* configured to provide access to the portion of the first cord 24*a* that is not sewn to the first and second vertical panels of the first inner pocket 12*a*; and the third vertical panel on the second inner pocket 12*b* includes an eyelet 20*f* configured to provide access to the portion of the second cord 24*b* that is not sewn to the first and second vertical panels of the second inner pocket 12*b*. The portion that is not sewn to the first and second vertical panels on inner pocket 12*a* is then introduced through a cord lock or stopper 25*a*, which in turn is configured to open and close the inner pocket 12*a* due to its interaction with the cord 24*a*. Similarly, the portion that is not sewn to the first and second vertical panels on inner pocket 12*b* is introduced through a cord lock or stopper 25*b*, which in turn is configured to open and close the inner pocket 12*b* due to its interaction with the cord 24*b*. Accordingly, a user of the handbag 101 can close the inner pockets 12*a*, 12*b* by holding the corresponding unsewn portion of the cord 24*a*, 24*b*, depressing the plunger P and pushing the cord lock 25*a*, or 25*b* towards the corresponding inner pocket 12*a*, 12*b*. Conversely, a user can open inner pockets 12*a*, 12*b* holding the corresponding unsewn portion of the cord 24*a*, 24*b*, depressing the plunger P, and pulling the cord lock 25*a*, or 25*b* away from the corresponding inner pocket 12*a*, 12*b*.

Lastly, it should be noted that, as shown in FIGS. 23C and 23F, each of the first lateral panel 4*a* and the second lateral panel 4*b* may include a gusset lateral reinforcement 26 sewn therein to provide support to the first and second lateral panels 4*a*, 4*b*. The gusset lateral reinforcement 26 includes a loop L configured to receive a hook or ring 27, wherein said hook or ring 27 is, in turn, configured to provide an attachment area for a strap, leash, or belt. In this manner, the handbag 101 can be used with a strap, leash, or belt.

It should be noted that the reversible handbag can be adapted to other bags or purses, as well as backpacks. In these embodiments the inner pockets are sewn to the front and back panels. In addition, the embodiments allow for closing options on the top of the bag, using for example a detachable zipper closure or using an elongated button.

Although certain exemplary embodiments and methods have been described in some detail, for clarity of understanding and by way of example, it will be apparent from the foregoing disclosure to those skilled in the art that variations, modifications, changes, and adaptations of such embodiments and methods may be made without departing from the true spirit and scope of the claims. Therefore, the above description should not be taken as limiting the scope of the invention which is defined by the appended claims.

The invention is not limited to the precise configuration described above. While the invention has been described as having a preferred design, it is understood that many changes, modifications, variations and other uses and applications of the subject invention will, however, become apparent to those skilled in the art without materially departing from the novel teachings and advantages of this invention after considering this specification together with the accompanying drawings. Accordingly, all such changes, modifications, variations and other uses and applications which do not depart from the spirit and scope of the invention are deemed to be covered by this invention as defined in the following claims and their legal equivalents. In the claims, means plus function clauses, if any, are intended to cover the structures described herein as performing the recited function and not only structural equivalents but also equivalent structures.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present invention, as well as equivalents thereof. The details in the patents, patent applications, and publications incorporated by reference herein may be considered to be incorporable at applicant's option, into the claims during prosecution as further limitations in the claims to patently distinguish any amended claims from any applied prior art.

What is claimed is:

1. A reversible and expandable handbag, comprising:

a front panel, a back panel, a bottom panel, a first lateral panel, and a second lateral panel interconnected with each other to define an interior of the handbag, wherein each panel comprises first and second vertical sides and first and second horizontal sides;

wherein the first horizontal side of the front panel is perpendicularly attached to the first horizontal side of the bottom panel, and the first horizontal side of the back panel is perpendicularly attached to the second horizontal side of the bottom panel;

wherein the first horizontal side of the first lateral panel is perpendicularly attached to the first vertical side of the bottom panel, and the first horizontal side of the second lateral panel is perpendicularly attached to the second vertical side of the bottom panel;

wherein the first vertical side of the front panel is attached to the first vertical side of the first lateral panel, and the second vertical side of the front panel is attached to the first vertical side of the second lateral panel;

wherein first vertical side of the back panel is attached to the second vertical side of the first lateral panel, and the second vertical side of the back panel is attached to the second vertical side of the second lateral panel;

wherein a first corner on the second horizontal side of the front panel is attached to a first corner on the second horizontal side of the first vertical panel, and a second corner on the second horizontal side of the front panel is attached to a first corner on the second horizontal side of the second lateral panel;

wherein a first corner on the second horizontal side of the back panel is attached to a second corner of the second horizontal side of the first lateral panel, and a second corner of the second-horizontal side of the back panel is attached to a second corner on the second horizontal side of the second lateral panel;

wherein the interior of the handbag further comprises a first inner pocket and second inner pocket, wherein the first inner pocket is attached to the first and second vertical sides of the first lateral panel and the second inner pocket is attached to the first and second vertical sides of the second lateral panel;

wherein the first inner pocket includes a first bottom end and the second inner pocket includes a second bottom end, each bottom end independent of the bottom panel;

wherein the first inner pocket comprises three vertical panels interconnected with each other and perpendicularly attached to the first bottom end, wherein the first vertical panel of the first inner pocket is connected to the first vertical side of the first lateral panel, the second vertical panel of the first inner pocket is connected to the second vertical side of the first lateral panel and the third vertical panel of the first inner pocket is connected to the first and second vertical panels of the first inner pocket;

wherein the second inner pocket comprises three vertical panels interconnected with each other and perpendicularly attached to the second bottom end, wherein the first vertical panel of the second inner pocket is connected to the first vertical side of the second lateral panel, the second vertical panel of the second inner pocket is connected to the second vertical side of the second lateral panel and the third vertical panel of the second inner pocket is connected to the first and second vertical panels of the second inner pocket;

wherein the first inner pocket and the second inner pocket include a closing mechanism configured to restrict access into the corresponding inner pocket;

a first mesh or fabric enclosure sewn to an upper portion of the three vertical panels on the first inner pocket and a second mesh or fabric enclosure is sewn to the upper portion of the three vertical panels on the second inner pocket;

wherein the closing mechanism includes a first cord having a first and second end respectively sewn to the first and second vertical panels of the first inner pocket, and a second cord having a first and second end respectively sewn to the first and second vertical panels of the second inner pocket;

wherein the handbag comprises a closing mechanism to restrict access into the interior of the handbag; and wherein the handbag is adapted to expand laterally by flipping the handbag inside out, thereby causing the first and second inner pockets to be located on the exterior of the handbag, which, in turn, causes the handbag to increase in size.

2. The handbag of claim 1 further comprising a first handle strap and a second handle strap, wherein the first handle strap is attached to the second horizontal side of the front panel and the second handle strap is attached to the second horizontal side of the back panel.

3. The handbag of claim 2, wherein the first handle strap includes a first extended portion that is fixed across the vertical length of the front panel starting at the second horizontal side of the front panel and ending at the first horizontal side of the front panel, and the second handle strap includes a second extended portion that is fixed across the vertical length of the back panel starting at the second horizontal side of the back panel and ending at the first horizontal side of the back panel.

4. The handbag of claim 3, wherein the first extended portion and the second extended portion are fixed to the bottom panel for reinforcement.

5. The handbag of claim 3 further comprising at least one pocket formed by a single cross-sewn panel across the front or back panel starting at the first vertical side of the front or back panel and ending at the second vertical side of the front or back panel, wherein said single cross-sewn panel intersects with the first or second extended portion that is fixed across the length of the front or back panel.

6. The handbag of claim 1 further comprising a bottom bias surrounding at least the first and second horizontal sides of the bottom panel;

a first lateral bias surrounding at least the first and second vertical sides of the first lateral panel as well as the first horizontal side of the first lateral panel;

a second lateral bias surrounding at least the first and second vertical sides of the second lateral panel as well as the first horizontal side of the second lateral panel;

a top bias surrounding at least the second horizontal side of the front panel, the second horizontal side of the back panel and the second horizontal side of the first lateral panel and the second lateral panel.

7. The handbag of claim 1, wherein the front panel and back panel of the handbag includes one or more eyelets configured to receive a cord having a first end and a second end.

8. The handbag of claim 7, wherein the one or more eyelets on the front panel align with the one or more eyelets on the second panel.

9. The handbag of claim 7, further comprising a cord lock configured to interact with the cord, in order to open and close the handbag.

10. The handbag of claim 1, wherein each of the first inner pocket and the second inner pocket includes a closing mechanism configured to restrict access into the corresponding inner pocket.

11. The handbag of claim 1, wherein the third vertical panel on the first inner pocket includes a first eyelet configured to provide access to a portion of the first cord that is not sewn to the first and second vertical panels of the first inner pocket, and the third vertical panel on the second inner pocket includes a second eyelet configured to provide access to a portion of the second cord that is not sewn to the first and second vertical panels of the second inner pocket.

12. The handbag of claim 11, wherein the closing mechanism of the first inner pocket comprises a first cord lock configured to interact with the first cord, in order to open and close the first inner pocket.

13. The handbag of claim 11, wherein the closing mechanism of the second inner pocket comprises a second cord lock configured to interact with the second cord, in order to open and close the second inner pocket.

14. The handbag of claim 1, wherein each of the first lateral panel and the second lateral panel includes a gusset lateral reinforcement sewn therein to provide support to the first and second lateral panels.

15. The handbag of claim 14, wherein the gusset lateral reinforcement in at least one of the of the first lateral panel and the second lateral, includes a loop configured to receive a hook or ring, wherein said hook or ring is, in turn, configured to provide an attachment area for a strap, leash, or belt.

* * * * *